US009273474B1

(12) United States Patent
Jimenez et al.

(10) Patent No.: US 9,273,474 B1
(45) **Date of Patent: *Mar. 1, 2016**

(54) APPARATUS AND METHODS FOR ERGONOMIC BUILDING TOOLS

(71) Applicant: Exceptional IP Holdings, LLC, Cary, NC (US)

(72) Inventors: Eduardo J. Jimenez, Manalapan, NJ (US); David B. Jalbert, Coventry, RI (US)

(73) Assignee: Exceptional IP Holdings, LLC

( * ) Notice: Subject to any disclaimer, the term of this patent is extended or adjusted under 35 U.S.C. 154(b) by 0 days.

This patent is subject to a terminal disclaimer.

(21) Appl. No.: 13/888,281

(22) Filed: May 6, 2013

Related U.S. Application Data

(63) Continuation of application No. 12/212,809, filed on Sep. 18, 2008, now Pat. No. 8,434,188.

(60) Provisional application No. 60/973,737, filed on Sep. 19, 2007.

(51) Int. Cl.
*B05C 17/10* (2006.01)
*E04F 21/16* (2006.01)
*E04F 21/06* (2006.01)

(52) U.S. Cl.
CPC ..... *E04F 21/16* (2013.01); *E04F 21/06* (2013.01)

(58) Field of Classification Search
CPC ..... E04F 21/16; E04F 21/06
USPC ..... 15/143.1, 210.1, 218, 218.1, 235.4, 15/235.6, 245.1; 16/431; 425/458
See application file for complete search history.

(56) References Cited

U.S. PATENT DOCUMENTS

| | | | | | |
|---|---|---|---|---|---|
| 38,044 | A | | 3/1863 | Howe | |
| 314,479 | A | | 3/1885 | Richardson | |
| 747,036 | A | * | 12/1903 | Bishop | 15/235.4 |
| 1,003,388 | A | * | 9/1911 | Wilson | 15/235.8 |
| 2,076,836 | A | * | 4/1937 | Goldblatt | 16/110.1 |
| 2,771,325 | A | * | 11/1956 | Brunson | 403/389 |
| 2,934,936 | A | * | 5/1960 | Vernon | 15/235.4 |
| 3,023,444 | A | * | 3/1962 | Tims, Jr. | 15/235.6 |
| 3,166,776 | A | * | 1/1965 | Selck | 15/235.6 |

(Continued)

FOREIGN PATENT DOCUMENTS

GB 2236502 A * 4/1991

*Primary Examiner* — Monica Carter
*Assistant Examiner* — Michael Jennings
(74) *Attorney, Agent, or Firm* — Wolff Law Offices, PLLC; Kevin Alan Wolff

(57) ABSTRACT

The present invention is directed generally to building tools with improved comfort in gripping and/or efficient control that may be used in various manners and orientations. A handle and work object (e.g., trowel blade) may be connected together by a connecting member (or connecting means) that may be a sloped, angled, and/or substantially curved member, so that a user has increased hand orientation options and/or control over the tool while gripping the handle and/or connecting member in various manners and orientations. In various embodiment(s), the connecting member (e.g., a tang for a trowel) may be a relatively gradually and/or notably sloped, angled, and/or curved structure that may reasonably provide a comfortable extension of the handle and augment the gripping of the tool. The various tools may include a handle connecting member having construction whereby a portion of the sides of the handle connecting member are removed. Magnesium may be used.

20 Claims, 15 Drawing Sheets

(56) References Cited

U.S. PATENT DOCUMENTS

| | | | | | |
|---|---|---|---|---|---|
| 3,460,183 | A * | 8/1969 | Harrington | 15/235.4 |
| D238,652 | S * | 2/1976 | Haivala et al. | D8/45 |
| 4,254,980 | A * | 3/1981 | Anderson | 294/15 |
| 4,467,492 | A * | 8/1984 | Harrington | 15/235.4 |
| D296,294 | S | 6/1988 | Neece | |
| 4,817,231 | A * | 4/1989 | Ocwieja | 15/235.4 |
| 5,193,244 | A * | 3/1993 | Meyers | 15/235.4 |
| D359,221 | S | 6/1995 | Pytlewski | |
| 5,479,675 | A * | 1/1996 | Pytlewski | 15/235.4 |
| 5,713,096 | A * | 2/1998 | Kelsay et al. | 15/235.4 |
| 6,018,841 | A | 2/2000 | Kelsay et al. | |
| 6,178,586 | B1 * | 1/2001 | Jafarmadar | 15/235.6 |
| 6,205,610 | B1 * | 3/2001 | Westthorp | 15/235.4 |
| 6,223,384 | B1 | 5/2001 | Kuhlen | |
| 6,247,204 | B1 | 6/2001 | Hamby et al. | |
| 6,513,199 | B1 * | 2/2003 | Cheng | 16/436 |
| 6,640,378 | B2 | 11/2003 | Hsu | |
| 6,668,417 | B1 * | 12/2003 | Slattery | 15/235.4 |
| D516,887 | S * | 3/2006 | Miller | D8/45 |
| 7,144,193 | B1 * | 12/2006 | Bousfield | 404/97 |
| D534,775 | S * | 1/2007 | Wang | D8/45 |
| 7,310,845 | B2 | 12/2007 | Gilli | |
| D561,549 | S * | 2/2008 | Hughett | D8/45 |
| 7,370,384 | B2 * | 5/2008 | Miller et al. | 15/236.08 |
| 7,493,671 | B2 | 2/2009 | Hurley et al. | |
| 7,506,398 | B2 * | 3/2009 | Martin | 15/235.8 |
| 7,694,380 | B1 * | 4/2010 | Meyers | 15/235.4 |
| 7,730,575 | B2 * | 6/2010 | Huang | 15/235.8 |
| 7,784,143 | B1 * | 8/2010 | Murray | 15/235.6 |
| 8,151,404 | B1 * | 4/2012 | Gundlach | 15/235.4 |
| 2001/0052163 | A1 * | 12/2001 | Kelsay et al. | 15/235.4 |
| 2005/0235447 | A1 * | 10/2005 | Wang | 15/235.4 |
| 2006/0162111 | A1 * | 7/2006 | Miller | 15/235.6 |
| 2007/0056133 | A1 * | 3/2007 | Pyatt et al. | 15/235.4 |
| 2007/0174988 | A1 | 8/2007 | Murray | |
| 2007/0192982 | A1 * | 8/2007 | Ho | 15/235.8 |
| 2008/0060169 | A1 | 3/2008 | Martin | |

* cited by examiner

APPARATUS AND METHODS FOR ERGONOMIC BUILDING TOOLS

This patent application claims priority to, and is a continuation of, U.S. patent application Ser. No. 12/212,809, filed on Sep. 18, 2008, which claims benefit of U.S. Provisional Patent Application No. 60/973,737, filed Sep. 19, 2007. These prior patent applications are hereby incorporated herein by reference for all purposes.

BACKGROUND

1. Field of the Invention

The present invention pertains to various building tools and methods related thereto. For example, the invention involves various methods and apparatuses for comfortably gripped and efficiently controlled building tools. Further, the invention involves various methods and apparatuses for high quality, durable and/or lightweight building tools.

2. Description of Related Art

Various tools have been known in the past for working with cements, concretes, mastics and/or muds to, for example, prepare, apply and/or finish a desired shape or smooth surface for various building surfaces. For example, some tools used for applying material to or preparing the surface of, for example, concrete, include trowels. These types of tools are typically hand tools that are used to apply materials for making and/or smoothing various building surfaces such as floors and walls and may be used to apply various materials to building surfaces. These tools may be used by skilled craftsman working on a number of surfaces for long periods of time during the work day. As such, a comfortable grip(s) may be particularly important in developing a most desirable building tool(s).

Referring to FIGS. 1A-1D, one typical prior art trowel including a trowel tang and blade is shown. A handle 110 for gripping is provided. The handle has a generally oval or round shape. In particular, referring to FIG. 1A, the trowel 100 includes a tang 150 that connects the trowel handle 110 to the trowel blade 105. The tang 150 includes a handle connecting member 151, a blade attachment member 152, and a handle support member 153 (see FIG. 1D) that all cooperate as a tang 150 in connecting the trowel handle 110 to the trowel blade 105. In the view of FIG. 1A, the connecting member 151 has a slight curve to its upper half so as to reflect its shape on either side to somewhat follow the round sides of the handle 110, but as shown below connecting member 151 has a side view that is substantially straight and vertical relative to the plane (horizontal when the trowel bottom surface of the blade is set on a horizontal surface) of the handle 110 and trowel blade 105. In other words, when looking at the trowel handle from the top as shown in FIG. 1C, the front or forward surface of the connecting member 151 of the tang has some curve to the left and the right of the center line, but when looking at the side view shown in FIGS. 1B and 1D, that from top to bottom the connecting member 151 is substantially straight and vertical having only a very slight slant relative to perfect perpendicular. Further, the back surface of the connecting member 151 is substantially flat and also approximately perpendicular to blade 105 and main axis of the handle 110. The very top, and a substantial portion of, the connecting member 151, is also as wide as the handle 110, so as to cover a forward face of the handle 110, resulting in a very abrupt drop and bulky front end surface to the tang 150.

Referring now to FIG. 1B, a side view of a prior art trowel and trowel tang is shown. As more clearly shown in FIG. 1B, the handle connecting member 151 is a substantially solid and straight member having a front surface 151A and a back surface 151B each with an approximately linear top-to-bottom and side-to-side slope. Further, the handle connecting member 151 has a narrow width measured from the front surface 151A to the back surface 151B. A typical trowel, for example, may have a handle connecting member 151 with a front-to-back width of approximately 1 cm (0.4 inches). The handle connecting member 151 is coupled at one end to the blade attachment member 152 at a connection point 154 slightly offset in a forward direction from the center of the blade attachment member 152. This typical trowel has a connection point 154 so that the front surface 151A meets the blade attachment member 152 at a point 154A having a distance of approximately 9.5 cm (3.75 inches) from a front end 152A of the blade attachment member 152 and the back surface 151B meets the blade attachment member 152 at a point 154B having a distance of approximately 11 cm (4.375 inches) from the front end 152A of the blade attachment member 152. Note that the front point 154A has an abrupt angle that is approximately 90 degrees, and the back point 154B has a slightly rounded connection point but is still approximately a 90 degree angle, with the vertical axis of the connecting member 151 being approximately perpendicular to the horizontal axis of the blade attachment member. As can be clearly seen from this side view in FIG. 2B, the handle connecting member 151 is also connected approximately perpendicular to the blade attachment member 152. The typical trowel may have a handle connecting member 151 with an angle (denoted 165) relative to the blade attachment member 152 of approximately 85 to 95 degrees. The blade attachment member 152 is elongated laterally across the trowel blade 105 and has a short height and narrow width that is used for coupling the blade attachment member 152 to the trowel blade 105. The typical trowel may have a blade attachment member 152 with a height and width both of approximately ⅔ to 1⅓ cm (0.25 to 0.5 inches). Substantially the entire top surface of the blade attachment member 152 is approximately parallel to the trowel blade 105 having no slope so as to be approximately the same height across its entire length, from its very forward most point at the end of section 152A, adjacent the connection point 154 of the connecting member 151 and blade attachment member 152 of the tang 150, and through the very rearward most end of section 152B.

Referring to FIG. 1C, a top view of a typical trowel is shown. From this view it can be seen that the handle member 110 with front portion 150 is approximately ⅓ the width of blade 105 and oriented to the center of the blade width. The constant width of the blade attachment member 152 is also illustrated as width 1F and 1G at ends 152A and 152B of the blade attachment member 152, respectively, and is the same in size. The blade attachment member 152 is mounted to the blade 105 at approximately the center of the blade width and extends across most of the blade 105 length. The handle 110 is held to the tang via a cap 115 and a nut or bolt 120. Most notably in FIG. 1C, the handle connecting member 151 is very narrow along the length of the blade 105. The top most portion 151C of the handle connecting member 151 is also very narrow and abuts the handle front portion 150, but is slightly narrow than the handle 110 and handle front portion 150. In any case, there is little lateral top surface of the handle connecting member 151 available onto which a user may place their hand, palm or finger on comfortably.

As more clearly shown in FIG. 1D, showing the handle 110 and cap 115 in cross sectional taken along line 1D and 1E of the FIG. 1C top view, the handle connecting member 151 is connected at its other end to the handle support member 153 so as to be approximately perpendicular to the handle connecting member 151 and approximately parallel to the blade attachment member 152 and trowel blade 105. As shown, the typical trowel may have the entire length of the handle support member 153 with an angle (annotated as 170) relative to the handle connecting member 151 angle of approximately 85 to 95 degrees, both relative to the plane of the blade attachment member 152. As previously indicated, the typical trowel also has a handle connecting member 151 with an angle (annotated as 165) relative to the blade attachment member 152 of approximately 85 to 95 degrees. The handle support member 153 includes a forward portion 153A and a rearward portion 153B, both approximately parallel to each other and approximately perpendicular to the handle connecting member 151. The rearward portion 153B is substantially round in shape and thinner than the forward portion 153A. The forward portion 153A of the handle support member 153 is substantially square in shape and thicker than the rearward portion 153B. The major lateral axis through hole of the handle 110 is substantially straight so that the substantially straight handle support member 153 may be assembled easily into the lateral through hole (from end to end of the handle 110) in the handle 110. An inside forward portion of the trowel handle 110 is through hole is hollowed with a similar square shape of the handle support member forward portion 153A such that the thickness and square shape of the forward portion 153A of the handle support member 153 allows the trowel handle 110 to snugly fit onto the handle support member 153 and prevents side-to-side rotation about a center axis of the trowel handle 110 during use. An end cap 115 and end nut 120, hollowed with a similar round shape, are attached to the end of the trowel handle 110 and handle support member 153, respectively, so as to prevent front-to-back sliding of the trowel handle 110 during use.

The trowel handle 110 has a top surface 110A and a bottom surface 110B and side surfaces (not labeled), which together provide a user with a gripping area and have only slight curvature due to a gradually increasing width in the trowel handle 110. The trowel handle 110 meets the handle connecting member 151 at a handle interface 145 (see FIG. 1A) in such a way that both the top surface 110A and the bottom surface 110B of the trowel handle 110 are adjacent to a portion of the handle connecting member 151 and are approximately perpendicular therewith.

These types of tools, for example trowels, are typically designed to be held by the hand of a user in a single manner and orientation. For example, with the typical prior art trowel shown in FIGS. 1A-1D, the user would most comfortably grip the handle coming from a the direction of the back end of the trowel (end with the end cap 115) with their fingers, palm and thumb of one hand surrounding the central portion of trowel handle 110. However, many users may find it more advantageous to shift, modify, and/or change the orientation of their method of holding the trowel or tool(s). Therefore, it is advantageous to build such trowel(s) or tool(s) to be comfortably gripped and efficiently controlled by the hand of a user in various manners and orientations so as to increase the comfort and control of such tools for various surfaces or for use during long periods of time.

In addition to being used on various surfaces and for long periods of time, these types of tools are exposed to various bumps, jolts and mechanical stresses, as well as corrosive substances in their use. Therefore, it is advantageous to build such tools to be cost effective, light in weight and durable against extensive use and stress as well as the corrosion from corrosive materials they are designed to work on (e.g., concrete, mastic, mud, etc.).

SUMMARY

The present invention is directed generally to building tools that have improved comfort in gripping and/or efficient control that may be easily used in various manners and orientations. Further, the present invention is directed generally to building tools that are high quality, durable, and lightweight so as to help reduce user fatigue that occurs from extended tool use. For example, various tools may connect a handle in approximately parallel orientation with and to a work object (e.g., tool blade) to be moved by means of the handle and manual hand motion. The handle and work object may be connected together by a connecting member (or connecting means) that is a sloped, angled, and/or substantially curved member, so that a user has increased hand orientation options and/or increased and improved control over the tool while gripping the handle and/or connecting member in various manners and orientations, now enabled, during use. In various embodiment(s), the connecting member (e.g., a tang for a trowel) may include at least one portion that is relatively gradually and/or notably sloped, angled, and/or curved structure that may reasonably provide a comfortable extension of the handle and not just connect the handle to the work object, but augment the gripping and control of the tool. Further, various tools may include a handle that is shaped to smoothly continue the slope, angle, and/or curvature of such handle connecting member so that a user may shift, modify, and/or change the orientation of his or her grip onto and/or along the handle connecting member so as to be closer to the work object to be moved, for increased control by comfortably overlapping his or her hand onto at least a portion of the handle connecting member. This may result in a handle connecting member that is an alternative and/or extension of the gripping locations that are available with the handle alone.

Still further, various tools may include a handle connecting member having construction whereby a portion of the sides of the handle connecting member are removed so as to reduce the weight of the tool and may be designed in such a way as to increasing the structural integrity of the handle connecting member. For example, the handle connecting member may be formed, at least in part, with an I-beam or ribbed structure or cross-section.

Yet further, various tool(s) may include a connecting member or means formed to connect the handle to the object to be moved (e.g., a blade) having additional means of an attachment member (e.g., blade attachment member) that is elongated laterally across the object to be moved, and may be at least partially gradually sloped downwardly (or built up or taller in various locations). For example, the attachment member may be at least partially gradually sloped downwardly from the point(s) where connected to the handle connecting member, so as to increase the strength of the connecting means and/or the connection point(s). Further, the at least partially gradually sloped downwardly attachment member may add little weight and maintaining most of the distance between the handle and itself and the object to be moved to ensure sufficiently large distance for comfortable gripping without obstructing a user's fingers or hand. Still further, the connecting member may have a narrower width closer to a connecting point to an attachment member (e.g., blade attachment member) than at a location that interfaces or abuts a handle portion. And still further, the connecting member may have, for example, a ¼ circle radius on both an upper surface and a lower surface such that the two surface (and the entire outer surfaces of the handle and connecting member) approximately follow one another in a relatively smooth circular radius or curvature that narrows the width of the connecting member from a location against which the handle rests and the connection point to the blade attachment member (e.g., following a reducing circumference along the front length of the handle that is the general design shape of the handle). Yet even further, various tools may be made, at least in part, using a material including, for example, magnesium for the connecting member and/or the attachment member (e.g., trowel tang) to help reduce the weight of the tool.

In various embodiment(s), a trowel may include(s) a tang that may connect(s) the trowel handle to the trowel blade. The trowel may be, for example, a concrete trowel including a cross-ground trowel, a flat back end finishing trowel, a round/round finishing trowel, etc. A handle connecting member may be included with the tang and may assist the tang in coupling the trowel handle to the trowel blade. A handle support member may also be included with the tang and may be attached to the handle connecting member in such a way that at least a portion of the handle support member is approximately parallel with the trowel blade. A blade attachment member may further be included with the tang and may be attached to the handle connecting member and elongated laterally across the trowel blade. The handle connecting member may be a sloped, angled, and/or substantially curved member having a cross section that is thicker in one area than another. In various embodiments, the handle connecting member may be a larger circular shape where it interfaces to the handle and taper to a smaller round or oval shape in an area close to where it connects to the blade attachment member. In the case where the handle connection member is substantially curved, the handle connecting member may have a curved top/front surface and a curved bottom/back surface that approximately follows the curvature of the top/front surface. In one variation, the top/front surface may be substantially convex (as viewed from the top surface perspective) and the bottom/back surface may be substantially concave (as viewed from the bottom surface perspective) so as to approximately follow the curvature of the top/front surface and curve toward a major axis of the trowel handle. In another variation, the handle outer surface may be curved and may be shaped so to follow the curvature of the top/front surface and the bottom/back surface of the handle connecting member until the handle is approximately parallel to the trowel blade. In this case, the smooth transition between the handle and the handle connecting member permits a user to shift his or her normal forward grip in a lateral direction toward and/or over or around the handle connecting member for increased control of the trowel blade while maintaining a comfortable lower forward grip. In addition, the sloped design and/or smooth transition between the handle and the handle connecting member may also facilitate a user reversing the orientation of his or her lower forward grip by 180 degrees for dealing with various surfaces or action with the trowel while maintaining a comfortable reverse grip. In this case, the user's palm may rest comfortably even though it is primarily on the connecting member. In still another variation, the handle connecting member may have an I-beam construction whereby a portion of the sides of the handle connecting member are removed so as to reduce the weight of the trowel without reducing the structural integrity of the handle connecting member. In yet another variation, the blade attachment member may be gradually sloped from approximately the point where connected to the handle connecting member, so as to increase the strength of such connection point between the handle connecting member and the blade connecting member. In yet another variation, the trowel may be made, at least in part, of a magnesium material so as to create a more light weight trowel. For example, the trowel tang may be made of a magnesium alloy or metal including magnesium.

Still further aspects included for various embodiments will be apparent to one skilled in the art based on the study of the following disclosure and the accompanying drawings thereto.

BRIEF DESCRIPTION OF THE DRAWINGS

The utility, objects, features and advantages of the invention will be readily appreciated and understood from consideration of the following detailed description of the embodiments of this invention, when taken with the accompanying drawings, in which same numbered elements are identical and.

DETAILED DESCRIPTION

Figure 1A:
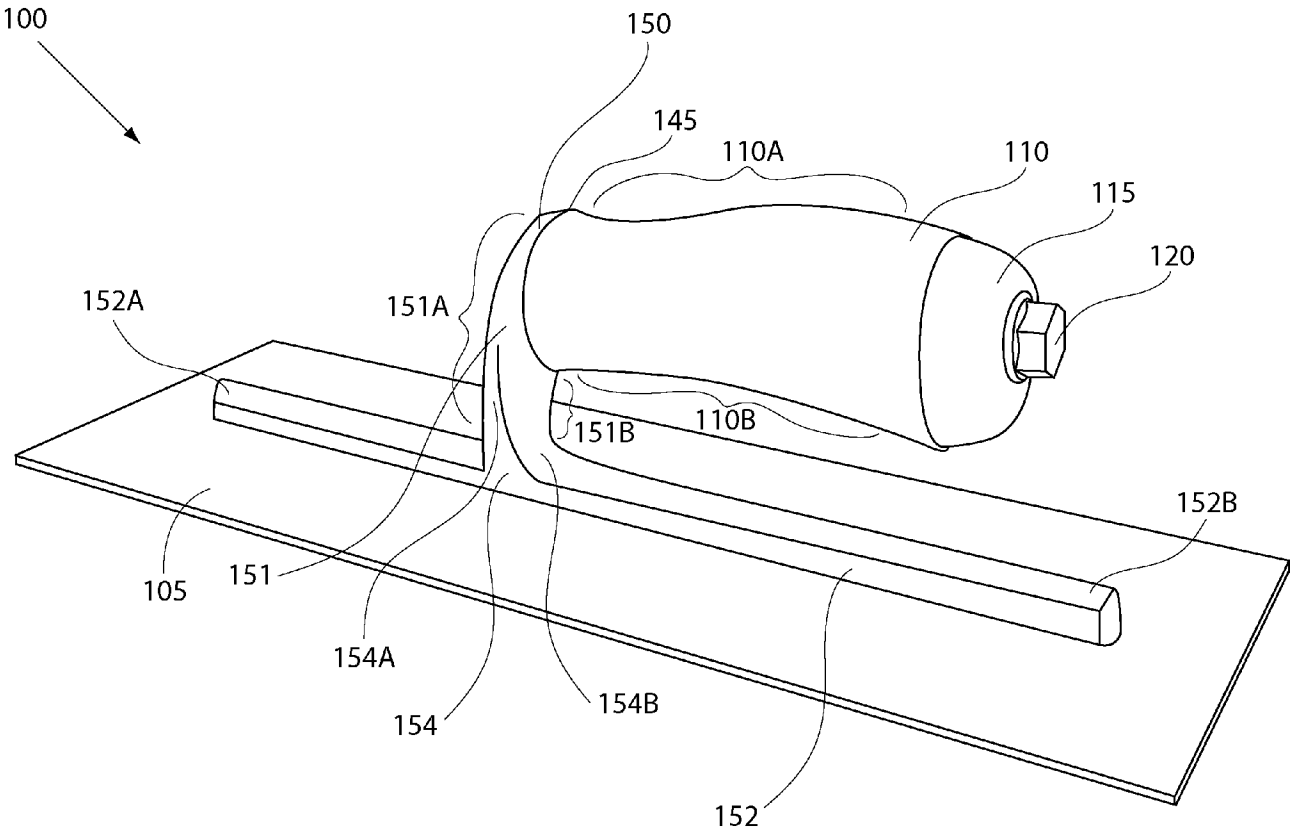
Figure 1A (Prior Art)
FIGS. 1A-1D depict a prospective view, side view, top view and partial cross-sectional side view, respectively, of a traditional trowel.
Figure 1B:
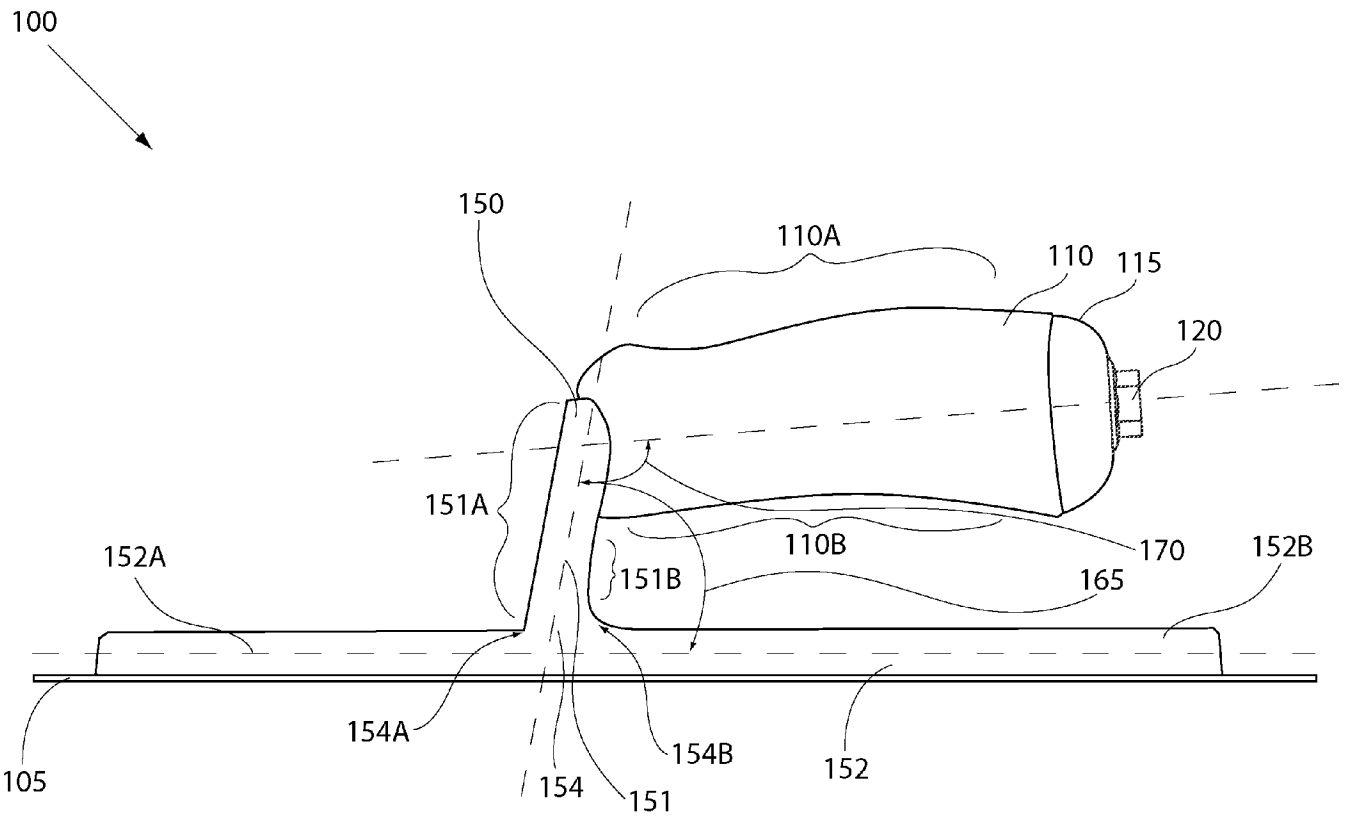
Figure 1B (Prior Art)
Figure 1C:
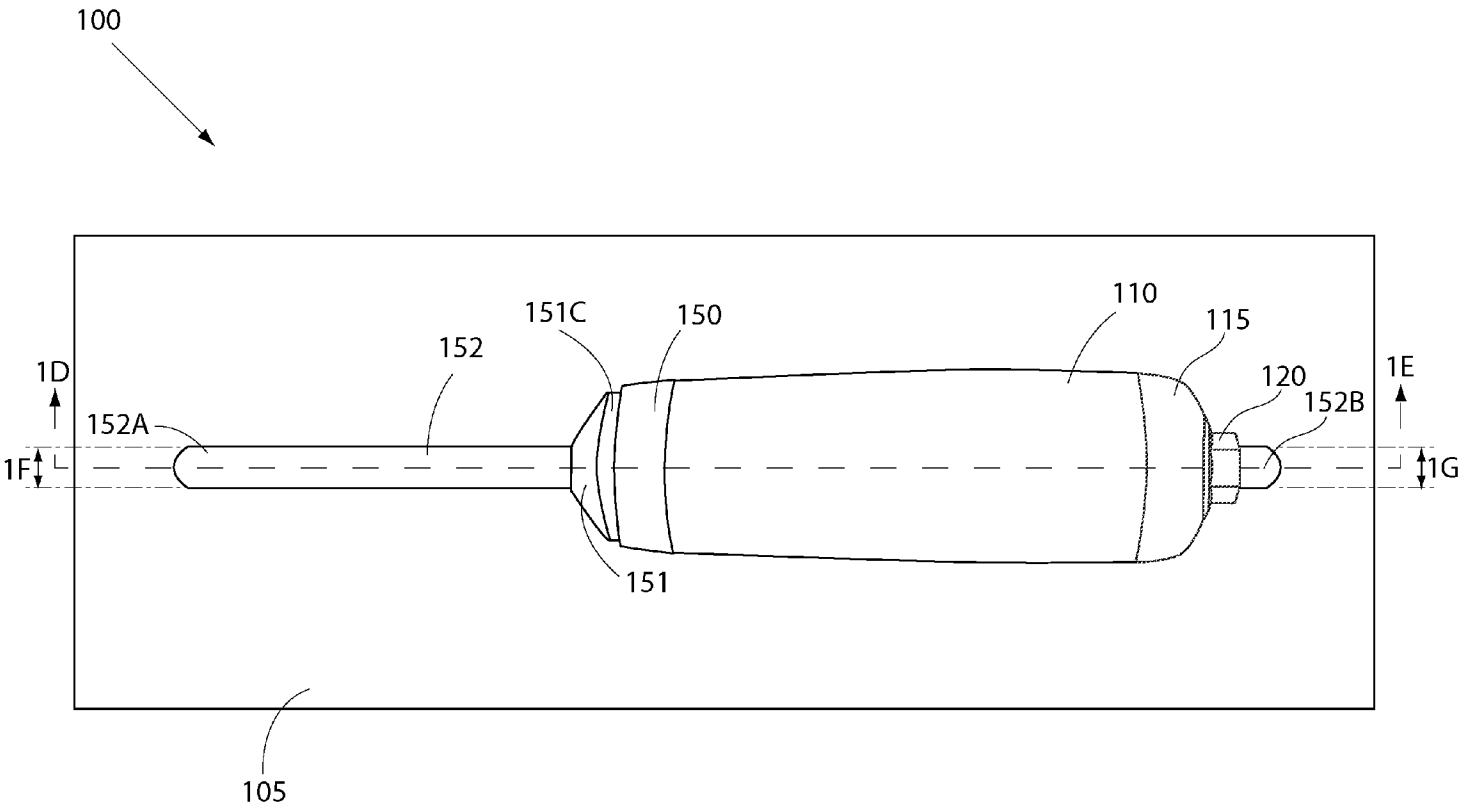
Figure 1C (Prior Art)
Figure 1D:
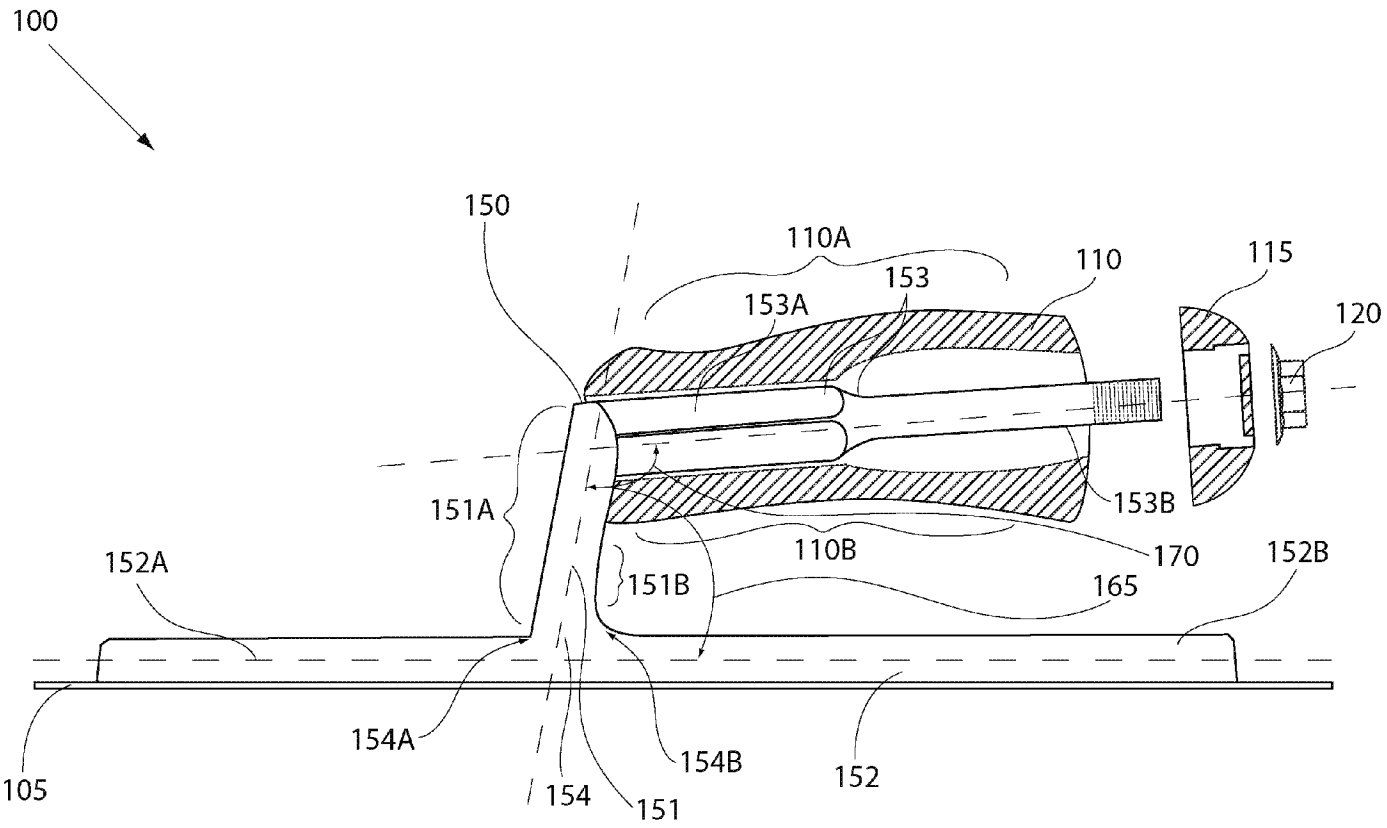
Figure 1D (Prior Art)

The present invention is directed generally to building tools that are comfortable to grip and efficient to control in various manners and orientations. The present invention is also generally directed to building tools that are high quality, durable and in some cases lightweight. As such, the present invention includes various embodiments showing various apparatuses and methods for working with, for example, concrete, masonry, mastic, mud(s), finishing drywall, etc. Various embodiment(s) are directed to a trowel that may typically be used for applying and/or smoothing various building surfaces such as floors, walls, etc.

Various embodiments of the present invention are directed to a new geometry of the tang and handle of hand tools, for example trowels, floats, etc., that may be used for working with concrete, masonry, mastics, muds, adhesives, etc. in the building trades. Historically, these types of hand tools have had tang and handle configurations that were connected to one another and to a blade at approximately right angles (as show by the prior art trowel show in FIGS. 1A-1D described above), leaving the only comfortable grip area to be on the handle portion. The present inventions "Grip Right" or "EZ Grip" has been designed with ergonomics so as to provide a feel good grip(s) that has multiple comfortable gripping areas and orientations so that the tool may be gripped high or low along a handle and handle connection member area (e.g., a full tang-handle length) so that a worker's hand feels comfortable and remains feeling good even after many hours of working with the tool. The present invention handle and handle connecting member may also be designed so that the handle and handle connecting member may be gripped comfortably closer to the tools working member (e.g., trowel blade) to increase directional control of the tool for precision performance. For example, the handle and handle connecting member may have a smooth transition, the handle-to-tool connecting member and handle may have a curved radius shape to fit into the palm or support the fingers of a worker's hand, and/or the handle-to-tool connecting member may be at an angle or slope to the handle and/or the working portion of the tool. The invention may also include various other unique aspects, like the use of an I-beam type construction to increase the strength of the handle connecting member while maintaining a light weight structure. The invention may also include various aspects relating to the tang to blade connecting feature where the tang has a non uniform geometry where it has a taller cross sectional height where the blade is attached. This further increases the strength of the tool while keeping the weight as a minimum. In any case, the present invention marks a significant advancement in hand tool handle and connecting member design that increase the ease, comfort and versatility of working with the hand tool(s). This is particularly true for the embodiments of trowels and/or floats described below, but as one skilled in the art would understand, the generalities of the present invention may be applied to various other handle and handle connection applications and be equally useful.

Figure 2:
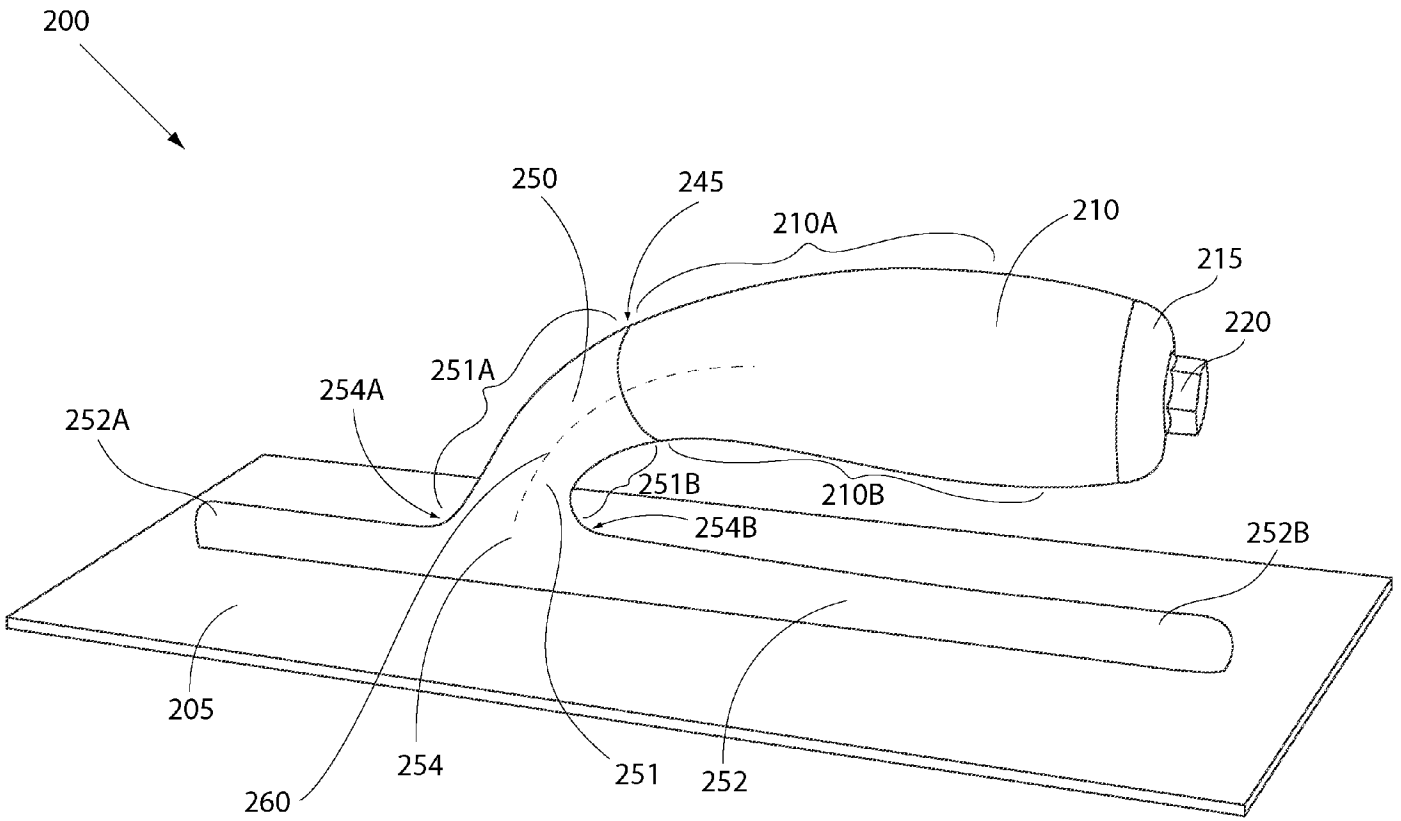
FIG. 2 is a perspective view of an exemplary trowel, according to at least one embodiment of the invention.

Referring now to FIG. 2, an exemplary trowel 200 according to one embodiment of the invention will now be described. A trowel 200 includes a tang 250 that connects the trowel handle 210 to the trowel blade 205. The tang 250 includes a handle connecting member 251 and a blade attachment member 252 that assist the tang 250 in coupling the trowel handle 210 to the trowel blade 205. The blade attachment member 252 is elongated laterally across the trowel blade 205 and is coupled at one side to the trowel blade 205. The handle connecting member 251 is coupled at one end to the blade attachment member 252 at a connection point 254 and at another end to the handle 210. In this case, the handle connecting member 251 may be a substantially curved member having a curved top/front surface 251A and/or a curved bottom/back surface 251B, each with an approximately non-linear top-to-bottom slope. In one variation, the top/front surface 251A may be substantially convex (as viewed from the top and front sides) and/or the bottom/back surface 251B may be substantially concave (as viewed from the bottom and back sides) so as to curve toward a major axis of the trowel handle 210. The bottom/back surface 251B may approximately follow the curvature of the top/front surface 251A so as to be approximately parallel thereto. In one variation, the handle connecting member 251 narrows from top-to-bottom when looking at it from the side and from the front. The substantially curved top/front surface 251A may have a convex curvature from approximately the location where it meets the trowel handle 210 at the handle interface 245, to the location where it meets the blade attachment member 252 at a point 254A. In order to provide a smooth connection between the top/front surface 251A and the blade attachment member 252, the substantially convex curvature of the top/front surface 251A may transition to being concave (as viewed from the top and front sides) at an inflection point 254A shortly before reaching the blade attachment member 252. This permits the top/front surface 251A of the handle connecting member 251 to gradually become parallel with a top surface of the blade attachment member 252, rather than having an abrupt angle formed at point 254A. This curved transition may help to strengthen the connection point 254A and provide a comfortable surface for resting a portion of a user's hand. The substantially curved bottom/back surface 251B may have a concave curvature (as viewed from the bottom and back sides) from approximately the location where it meets the trowel handle 210, at the handle interface 245, to the location where it meets the blade attachment member 252 at a point 254B. In order to provide a smooth connection between the bottom/back surface 251B and the blade attachment member 252, the substantially concave curvature of the bottom/back surface 251B may remain concave past a point 254B where the bottom/back surface is perpendicular to a top surface of the blade attachment member 252. This permits the bottom/back surface 251B of the handle connecting member 251 to gradually become parallel with a top surface of the blade attachment member 252. These substantially curved surfaces (251A and 251B) of the handle connecting member 251 also provide a location sufficiently parallel to the trowel blade 205 so that a user may comfortably rest or surround his or her hand in order to apply a force in a direction perpendicular and/or parallel to the trowel blade 205. This area of the connecting member 251 is thus designed to not only support the handle 210, but also so that it may be used itself as a hand support and/or grip area (by itself or in conjunction with the handle 210) and may provide increased control over the trowel blade 205 during use because a user's hand may reside closer to the connection point 254 and trowel blade 205. It is also noteworthy that the interface location 245 between the handle connecting member 251 and the handle 210 may be in a forward direction and angled toward the front of the trowel 200 at an angle that is not substantially perpendicular to the lateral axis of the handle 210.

In another variation, the handle connecting member 251 may be a substantially rounded member having a rounded top/front surface 251A and/or a rounded bottom/back surface 251B, each with an approximately non-linear side-to-side slope. Of course, the top/front surface 251A and the bottom/back surface 251B may meet at a location on the side of the handle connecting member 251 so that the handle connecting member 251 has an approximately circular or oval shape. These substantially rounded surfaces (251A and 251B) of the handle connecting member 251 provide a smooth, comfortable, and ergonomic location that a user may rest or surround his or her hand during use. In various embodiments, the handle connecting member 251 and at least a portion of the handle 210 may share a radial centerline axis 260 that is a smooth arc from connection point 254 into approximately one fourth of the handle 210 that is closest to the handle connecting member/handle interface 245. In one variation, the handle connecting member 251 may be both a substantially curved member from top-to-bottom and a substantially rounded member from side-to-side. In this case, the substantial curvature of the handle connecting member 251 permits a user's hand to rest on or surround the handle connecting member 251 in order to apply a force in a direction perpendicular and/or parallel to the trowel blade 205, while the substantial roundness of the handle connecting member 251 increases the comfort of such action. Of course, in at least one variation, rather than being curved, the connecting member front/top surface and/or back/bottom surface, may be substantially straight and at an angle relative to the plane of the blade 205 and lengthwise axis of the handle 210.

In still another variation, the handle connecting member 251 may have a widened width measured from the front surface 251A to the back surface 251B. For example, the handle connecting member 251 may have a front-to-back width of approximately 1.5 to 2.5 cm (0.6 to 1.0 inches) that may vary along the radial curved center axis of the handle connecting member 251. At the lower location near the connection location 254, the thicker width may provide an increase in the strength of the handle connecting member 251 with the blade attachment member 252 so that significant forces being applied by a user to the handle and/or handle connecting member 251 by a user during use of the trowel 200 does not break the tang. The thicker width may also provide a user with a more substantial support or grip structure so that a user may more comfortably and ergonomically rest or grasp the handle connecting member 251.

In yet another variation, the trowel handle 210 may also be a somewhat curved member having a curved top/front surface 210A and/or a curved bottom/back surface 210B, each with an approximately non-linear or curved top-to-bottom slope. The top/front surface 210A may be somewhat convex and/or the bottom/back surface 210B may be somewhat concave so as to curve from the outer surfaces of the handle connecting member 251 toward a major axis of the trowel handle 210. The curvature of the top/front surface 210A and/or the bottom/back surface 210B of the trowel handle 210 may continue or follow the curvature of the top/front surface 251A and/or the bottom/back surface 251B of the handle connecting member 251. In one exemplary embodiment shown in FIG. 2, the curvature of the trowel handle 210, however, continues only until a major axis of the trowel handle 210 is approximately parallel with the blade attachment member 252 and trowel blade 205. Further, a shallow circular or oval indentation where a user's thumb or index finger might be placed on the top/front surface 210A of the handle 210 while gripping in a normal forward manner may provide a comfortable and ergonomic grip (see, for example, the top view in FIG. 7, item 765). This shallow indentation may only be a slight aberration in the curvature of the top/front surface 210A so that the top/front surface 210A may still be said to continue the curvature of the top/front surface 251A of the handle connecting member 251. In order to provide a smooth transition between the handle connecting member 251 and the trowel handle 210, the front-to-back width of the trowel handle 210 near the handle interface 245 also follows the front-to-back width of the handle connecting member 251 (and visa versa). In this case, the smooth transition between the trowel handle 210 and the handle connecting member 251 effectively adds length to the available hand support or grip area because a user's hand may comfortably, easily, and ergonomically overlap the handle interface 245 onto the top/front surface 251A and bottom/back surface 251B of the handle connecting member 251. Although not shown clearly in FIG. 2, the sides of the trowel handle 210 and the handle connecting member 251 may also be coincident, at least at the handle interface 245. The hand support or grip area, therefore, may be enlarged to consist not only of the top/front surface 210A, at least portions of the side surfaces, and the bottom/back surface 210B of the trowel handle 210 but also the top/front surface 251A, at least portions of the side surfaces, and the bottom/back surface 251B of the handle connecting member 251. As the tang 250 including the handle connecting member 251 may be made, at least in part, of metal, the enlarged hand support or grip area may include metal.

In still another variation, the tang 250 may be made completely, or at least in part, of a material including magnesium, aluminum, long fiber carbon or glass filled materials, etc., so as to create a more light weight trowel. The material including magnesium may be magnesium alloy. For example, a magnesium alloy such as AZ31C containing approximately the following approximate percentages of materials: Magnesium: Al: 2.5-3.5%; Cu: 0.05% max; Fe 0.005% max; Mn 0.20% min; Ni 0.005% max; Si 0.30% max; Zn 0.60-1.40%; Ca 0.30% max; OT 0.30% max; Mg the remainder %. This composition or alloy of Magnesium may be particularly useful for forming parts by extrusion. Further, the formulation may have variations from those above, for example, the composition of magnesium may vary within the above by +/−5% for Al and Mg, and +5% on Mn. Another useful magnesium compound or alloy, may include the following substances in the following amounts: Aluminum (Al) at 8.5% to 9.5%; Copper (Cu) at 0.25% maximum; Manganese (Mn) at 0.15% minimum; Nickel (Ni) at 0.01% maximum; Silicon (Si) at 0.20% maximum; Zinc (Zn) at 0.45% to 0.9%; other materials (OT) at 0.30% maximum; and Magnesium (Mg) is the % remainder. This composition of Magnesium may be particular good for forming parts by casting. Further, other formulations are possible, such as the formulation of the magnesium alloy may vary within the above by +/−5% for Al and Mg, and +5% on Mn. The trowel blade 205 may be made of high carbon steel covered with a clear coat or from Stainless Steel.

The blade attachment member 252 and handle connecting member 251 may be part of an integral tang 250 made of the same material or may be welded together and made of the same or different materials such as materials including, for example, aluminum and/or magnesium. Of course, one skilled in the art would appreciate that a connecting member or tang of lightweight magnesium alloy may be useful in coupling a blade and a handle for a variety of other hand tools or other applications not specifically described herein where desired ergonomics, weight, durability, gripping and strength may be similar to the trowel described herein as exemplary embodiments.

The present invention may be made using the following process. The trowel 200 may be assembled form various parts. The handle 210 may be typically molded from various types of plastic and may (but need not) have an over-molded soft surface such as a thermoplastic elastomer. The tang 250 described in detail above may be produced by a casting process which produces a nearly finished part directly out of the mold. Cleaning excess parting line material from the casting process and machining the tang attachment features may complete the process for these parts. The trowel blade 205 may be stamped from hard sheet metal. In this manner, the blade 205 blank may then have fastening studs, or posts welded in place along the center of the blade. These studs may match mating holes machined into the base of the tang. The posts and mating holes may be spaced approximately 1-2 inches apart. The tang 250 may then be pressed onto the posts permanently securing the tang to the blade. The handle 210 may then be assembled onto the tang 250 and secured with an end cap (similar to FIG. 1) or plug (not shown in FIG. 2, 315 in FIG. 3) and nut 220 or nut 220 alone.

Figure 3:
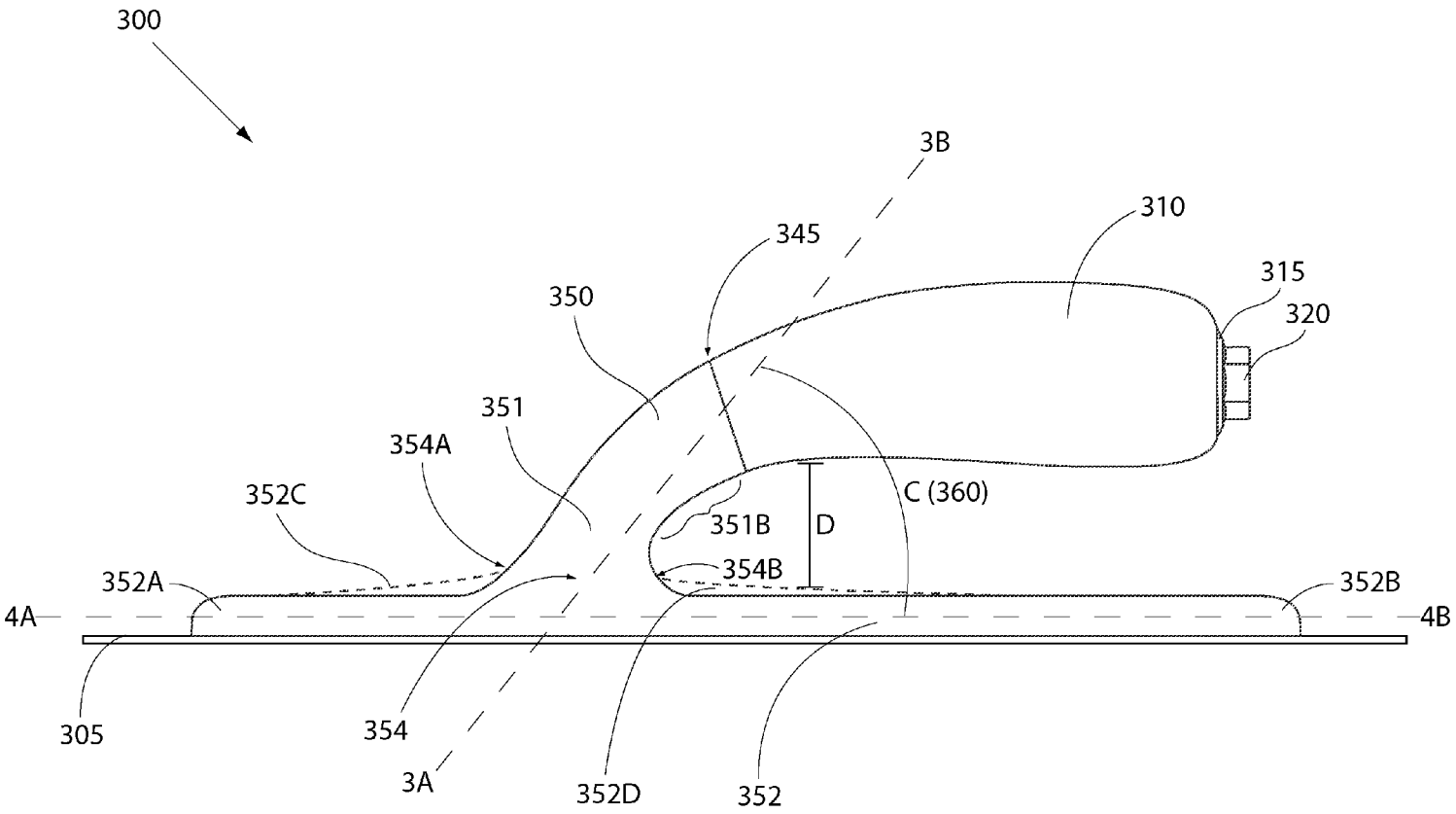
FIG. 3 is a side view of an exemplary trowel, according to one embodiment of the invention.

Referring now to FIG. 3, this embodiment shows a side view of a trowel 300 as viewed from the left side. Although not shown, the right side view may be a mirror image of the left side view. The trowel 300 of this embodiment is similar to the trowel in the embodiment shown in FIG. 2, but includes an angled handle connecting member 351 that may be connected to the blade attachment member 352 at a forward position with increased strength due to an inclined upper surface of the blade attachment member 352 near the connection point 354. In this case, the handle connecting member 351 may be connected to the blade attachment member 352 in such a way that a major axis of the handle connecting member 351 along the line from "3A" to "3B" has an angle or slope, C (360), relative to a major axis of the blade attachment member 352 along the line from "4A" to "4B" of approximately 30 to 60 degrees. In a preferred embodiment, the angle or slope, C (360), between the handle connecting member 351 and the blade attachment member 352 is, for example, approximately 45 degrees. The slope may vary between, for example, approximately 20 degrees and approximately 75 degrees. This angle or slope, C (360), of the handle connecting member 351 relative to the blade attachment member 352 may provide increased control over the trowel blade 305 while gripping the trowel handle 310. As this angle or slope, C (360), may also contribute to determining the area or distance, D, in between the trowel handle 310 and the blade attachment member 352, the angle or slope, C (360), may be sufficient to provide an area along the bottom/back surface 310B of the handle 310 that may be gripped by a user's finger(s) or hand. For example, with the handle connecting member 351 at an angle of approximately 45 degrees relative to the blade attachment member 352, the area between the bottom/back surface 310B of the trowel handle 310 and the blade attachment member 352 may be approximately 2.5 to 3.5 cm (1 inch to 1.3 inches). Further, the angle or slope, C (360), may also be sufficient to provide an area along the bottom/back surface 351B of the handle connecting member 351 that may be gripped by a user's finger(s) or hand. For example, with the handle connecting member 351 at an angle of approximately 45 degrees relative to the blade attachment member 352, the area between the bottom/back surface 351B of the handle connecting member 351 and the blade attachment member 352 may be approximately 1.5 to 2.5 cm (0.6 inches to 1 inch).

The handle connecting member 351 may also be connected laterally along the blade attachment member 352 at an approximately forward connection point 354 toward the front end of the blade attachment member 352A. For example, the trowel 300 may have a connection point 354 so that the front surface 351A meets the blade attachment member 352 at a point 354A having a distance of, for example, approximately 6.5 to 7.5 cm (2.5 to 3.0 inches) from a front end 352A of the blade attachment member 352 and the back surface 351B meets the blade attachment member 352 at a point 354B having a distance of, for example, approximately 10 to 11 cm (4 to 4.375 inches) from the front end 352A of the blade attachment member 352. This forward connection point 354 may provide increased control over the trowel blade 305 while gripping the trowel handle 310, especially where the handle connecting member 351 is substantially curved and may thereby shift the position of the trowel handle 310 more towards the rear of the trowel 300.

The connection point 354 between the handle connecting member 351 and the blade attachment member 352 may be strengthened by forming it to have included a gradually sloping top surface, for example, at least a portion of an upper surface of the blade attachment member 352 on either side, or both sides, of the connection point 354. A forward sloping surface 352C (shown as a dashed line) may gradually incline from the front end 352A of the blade attachment member 352 to a point 354A where the top/front surface 351A of the handle connecting member 351 meets the blade attachment member 352. Of course, the forward sloping surface 352C may begin its gradual incline from any point along the entire length of the blade attachment member 352 between the front end 352A and the point 354A. Likewise, a rearward sloping surface 352D (shown with dashed line) may gradually incline from any point along the rear of the blade attachment member 352, for example, at a midpoint thereof or near end 352B of the blade attachment member 352, to a point 354B where the bottom/back surface 351B of the handle connecting member 351 meets the blade attachment member 352. Of course, the rearward sloping surface 352D (shown with dashed line) may also begin its gradual incline from any point along the entire length of the blade attachment member 352 between the rear end 352B and the point 354B. In one embodiment like shown in FIG. 2, the rearward sloping surface 352D may begin its gradual incline from approximately the center of the length of the blade attachment member 352 between the rear end 352B and the point 354B. These inclined surfaces (352C and 352D) may provide additional structural strength to the connection point 354 so that a user may apply additional force to the trowel handle 310 and handle connecting member 351 without fracturing or breaking the trowel tang at connection point 354. This is particularly important when using lighter weight material(s), such as a magnesium alloy or compound as the tang material, that is less strong.

Figure 4:
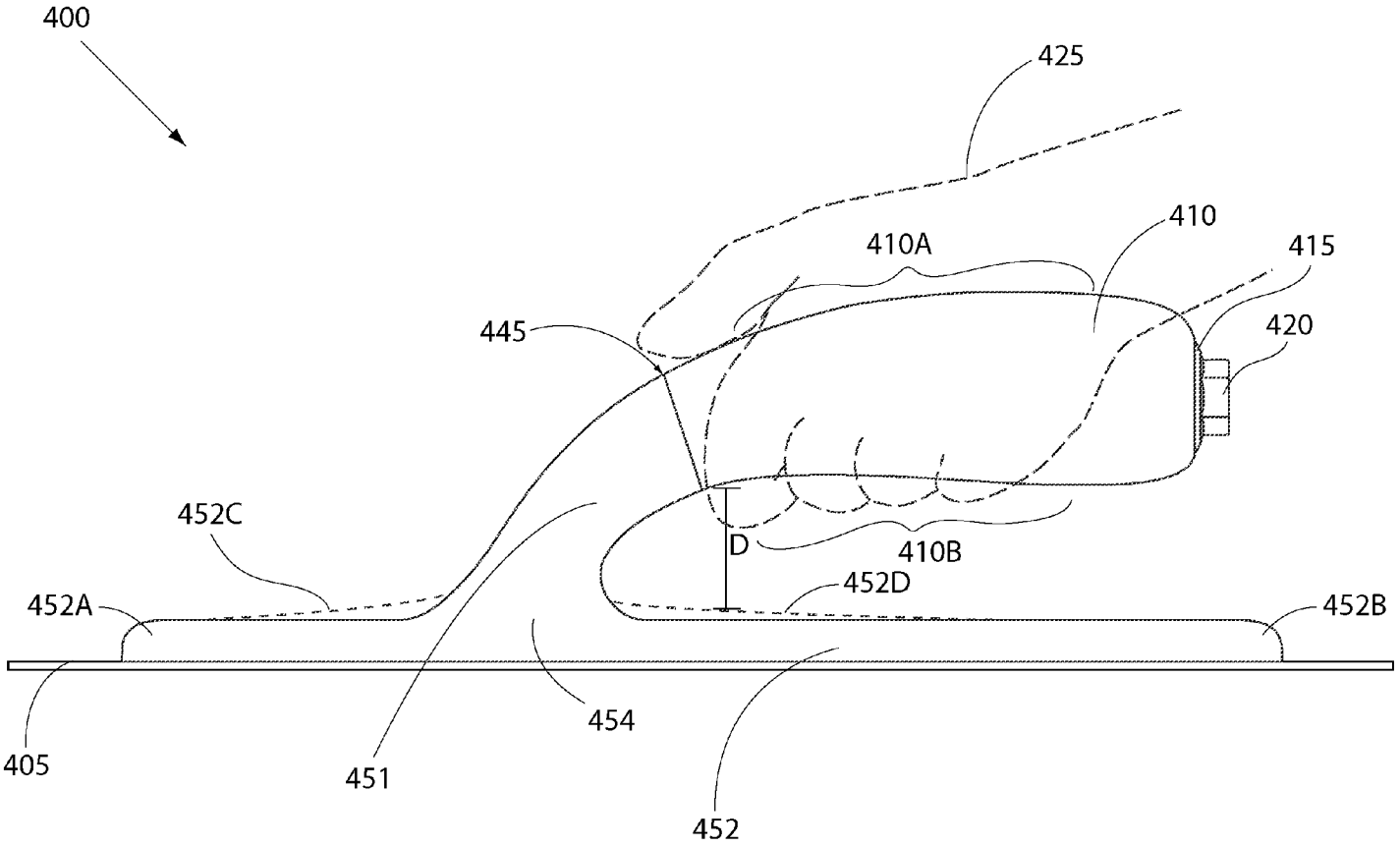
FIG. 4 illustrates a typical gripping on the handle area of an exemplary trowel, according to at least one embodiment of the invention.

Referring now to FIGS. 4, 5A-5B, and 6A-6B, various embodiments of the present invention are shown that include exemplary manners and orientations in which a user may grip the exemplary trowel. FIG. 4 shows a side view of a trowel 400 having one exemplary unique tang design according to at least one embodiment of the present invention and illustrate it as being gripped in a fairly typical or normal forward manner. As shown, when gripping the trowel in a forward manner the user's hand 425 (in this example the user's left hand shown in dashed lines) is gripping the trowel handle 410 only with the fingers encircling the sides and lower handle area 410B, while the palm of the user's hand and the thumb abut the upper handle surface 410A. In this case, the hand gripping is achieved entirely on the handle 410 and does not touch, cover or encroach on the handle connecting member 451. The user's arm in this grip is approximately parallel with the major lateral axis of the handle 410 and the major lateral axis of the blade attachment member 452. This is a fairly typical user's grip as is used with typical trowel and trowel tang designs (e.g., FIGS. 1A-1D). Further, with this particular tang design, having an approximately 45 degree slope of the handle connecting member 451, and hand 425 with grip illustration shown in FIG. 4, one can see that the distance D between the bottom surface 410B and top of the blade attachment member 452 provides plenty of room for the user's fingers when gripping the handle 410 in the forward manner. In fact, the slope of the handle connecting member 451 may be change to approximately 30 degrees and still provide sufficient distance D, with or without the increased height 425D of blade attachment member 452.

Figure 5A:
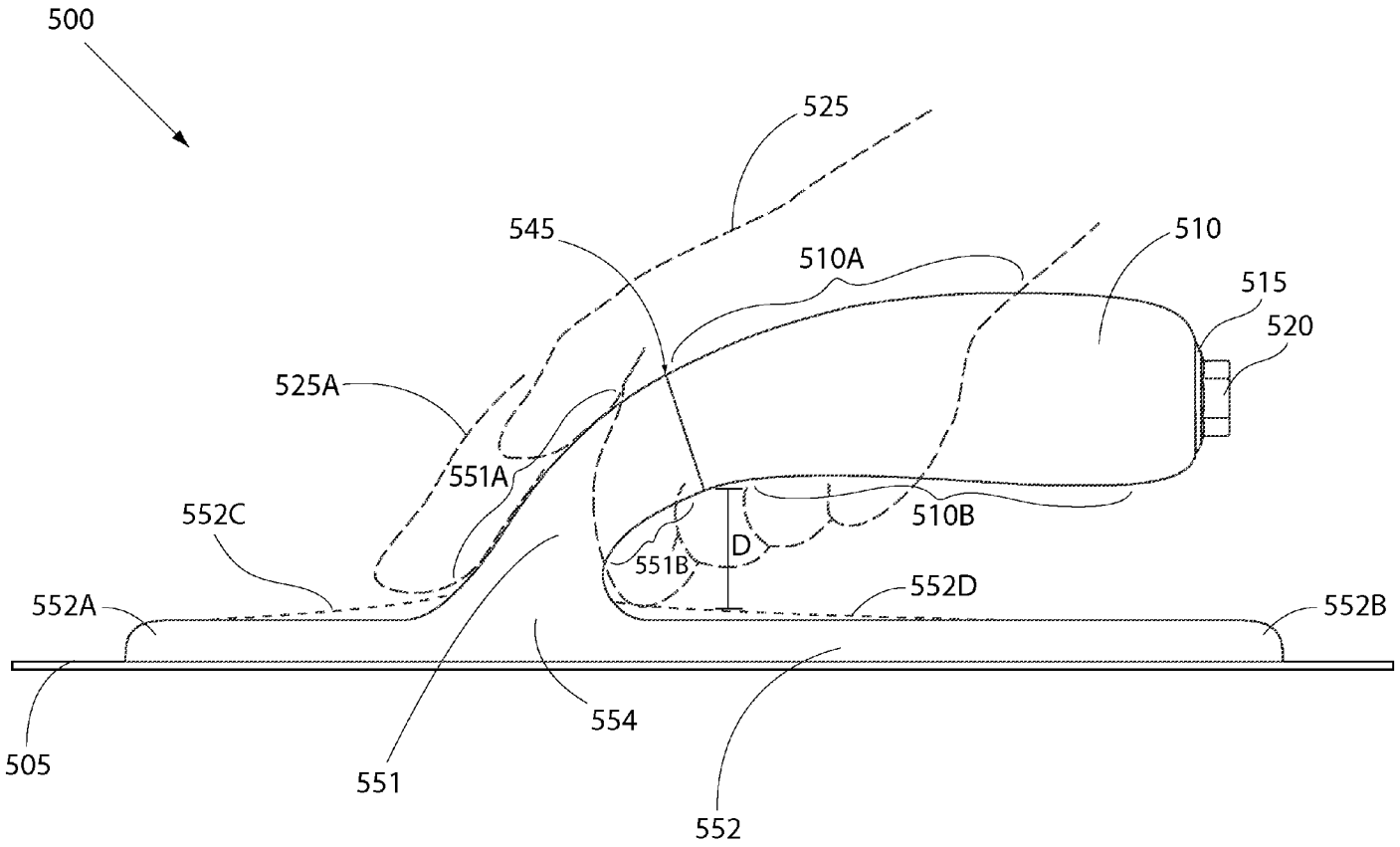
FIGS. 5A-5B illustrates two of the possible forward gripping orientations of an exemplary trowel, according to at least one embodiment(s) of the invention.

Referring now to FIG. 5A, a side view of a trowel 500 is shown according to one embodiment of the present invention and includes further exemplary illustrations of how a user may grip the handle 510 and handle connection member 551 in a lower forward manner. In one exemplary manner, the hand 525 (shown in dashed lines) may be shifted forward and downward onto the tang (550) so as to cover a portion of the handle connecting member 551 and the handle 510. As shown, in this gripping manner the index finger of the hand 525 may surround the back/underside surface 551B and the thumb may abut a portion of the front/top surface 551A of the handle connection member 551. The thumb side of the palm of the hand 525 may cover the interface 545 between the handle 510 and the handle connection member 551. In one variation, the thumb of the user's hand 525 may be advanced lower on the front/top surface 551A of handle connection member 551 so as to the be adjacent to or abut the upper surface of the front portion 552A (or surface 552C) of the blade attachment member 552. In any case, the index finger of hand 525 may comfortably rest against or abut the lower back concave area where the handle connection member 551 and the back part of blade attachment member 552 meet. Furthermore, if the tang includes strengthening slope 552D on the back portion of blade attachment member 552, the index finger may also abut or rest on this raised surface also, while the distance D is sufficient for the index finger to comfortably fit into this are of the tang. These forward gripping positions are facilitated by the angled and smooth transition handle connection member 551 and may provide more stable control of the trowel during various uses.

Figure 5B:
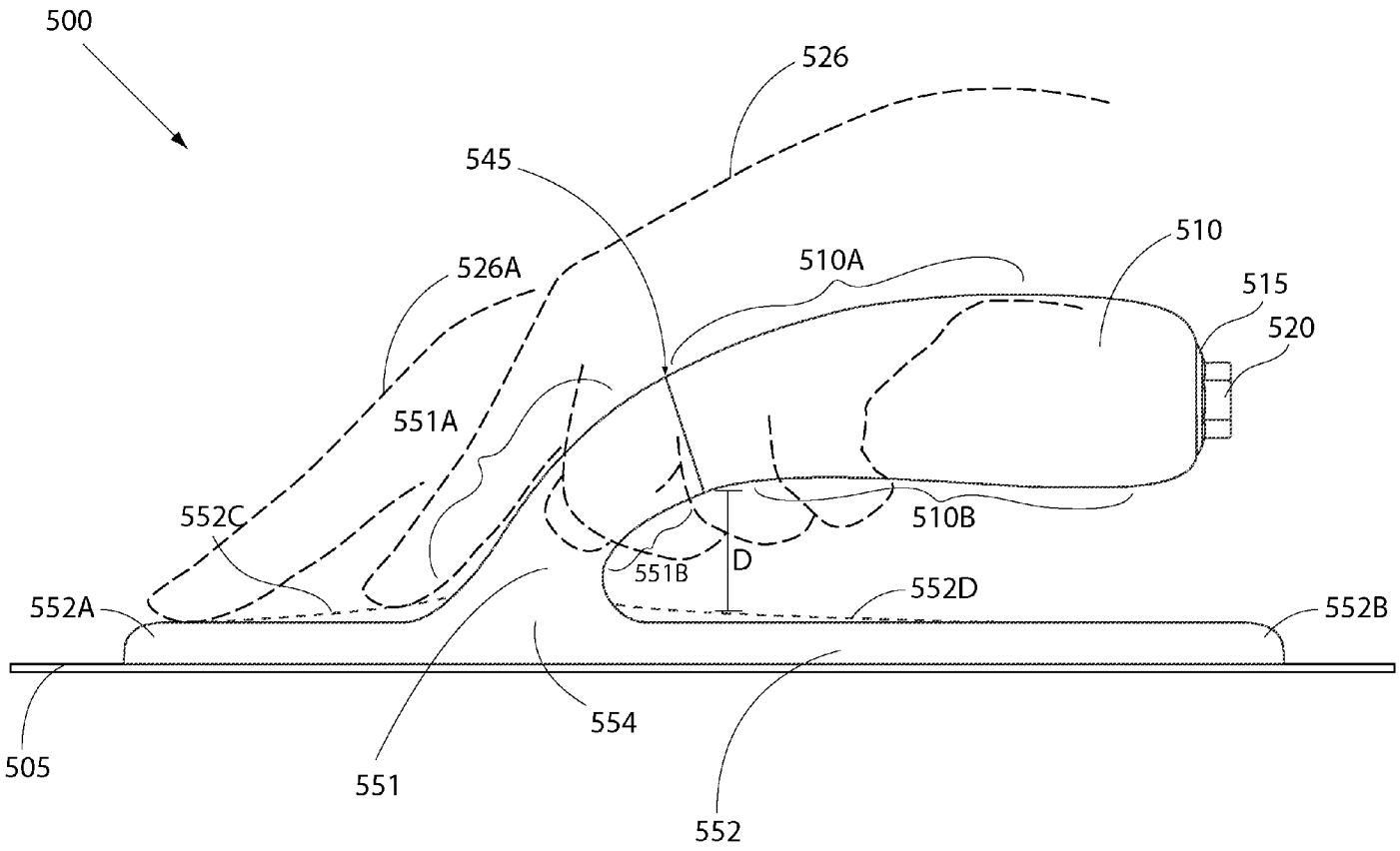

Referring now to FIG. 5B, a side view of a trowel 500 is shown according to one embodiment of the present invention and includes a grip similar to the grips shown in FIG. 5A in a lower forward manner. However these exemplary grips are modified so that the top/front surface 551A of the handle connecting member 551 is used as primarily a hand grip support with much of the palm of the hand 526 resting on the handle connection member 551. In these cases, the index finger of the hand extended so that the tip of the finger rests along the top/front surface 551A of the handle connection member 551. Alternatively, the index finger may be extended (526A) so that the index finger tip rests on the front portion 552A of the blade attachment member 552 while the rest of the index finger no longer rests on the top/front surface 551A of the handle connection member 551. In this case, the palm of the hand 526 (shown in dashed lines) may be shifted forward a bit so that most of the palm of the hand straddling interface 545 is forward of interface 545. As such, the middle finger may then abut the curved surface in the rear of the connection area 554 between the handle connecting member 551 and the blade attachment member 552. Once again, these forward gripping positions are facilitated by the angled and smooth transition handle connection member 551 and may provide more stable control of the trowel during various uses.

Figure 6A:
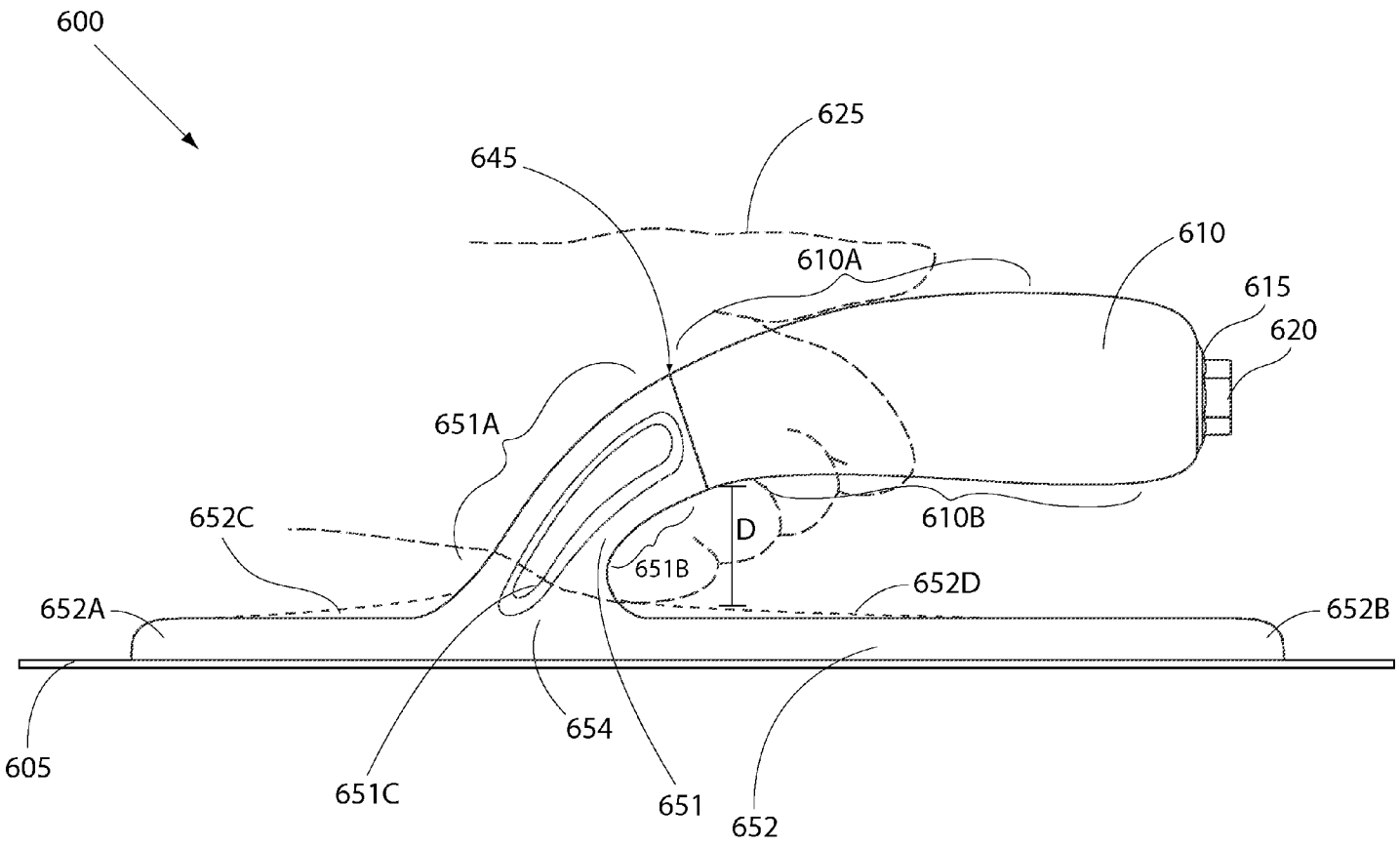
FIGS. 6A-6B illustrate two of the possible reverse gripping orientations of an exemplary trowel and the inclusion of removing some material along a connecting member, according to at least one embodiment of the invention.

Referring now to FIG. 6A, a side view of a trowel 600 according to one embodiment of the present invention is shown that includes a cut out side area 651C and another exemplary hand 625 (shown in dashed lines) grip orientation, a reverse grip. In this example, a lower reverse hand grip orientation is shown. In the lower reverse hand grip orientation, approximately one half of the palm of the hand 625 may rest comfortably on the forward/top surface 651A of the handle connecting member 651 and may straddle interface 645 between handle connecting member 651 and the handle 610 with a large portion of the palm resting on the forward most portion 610A of the handle 610. The four fingers may surround the sides and the lower/back portion 651B of the handle connecting member 651 and the sides and lower portion 610B of the handle 610, with the majority of the finger grip area being on the handle 610. Although, the butt of the palm of the hand 625 rests squarely on the handle connecting member 651 and provides the primary force during working with the trowel 600. Given the smooth radial curvature of the handle connecting member's 651 front/top surface 651 and bottom/back surface 651B, a comfortable and controlled reverse hand grip is enabled and there are no abrupt angles or edges on the trowel tang that may cause discomfort or blisters from extended reverse hand grip use of the trowel. In this embodiment the pinky finger may fit comfortably in the rounded rear facing surface of the connection area of the handle connecting member 651 and the blade attachment member 652 at connection area 654 as a result of sufficient distance D. This embodiment also shows that the pinky finger may abut the bottom/back surface 651B of the handle connecting member 651 and may abut the top of the blade attachment member 652, particularly if a slope 652D is provided.

Further, the exemplary trowel shown in FIG. 6A includes a cut-away, indent, or valley area 651C in the side of the handle connecting member 651. The opposite side of the handle connecting member 651 may be symmetrical to the side shown in FIG. 6A. This area may help to reduce the weight of the tang and trowel, with little or no loss of the strength of the handle connecting member 651 by forming an I-beam type cross section of the handle connecting member 651. This variation will be described in more detail below with reference to FIGS. 8-10C.

Figure 6B:
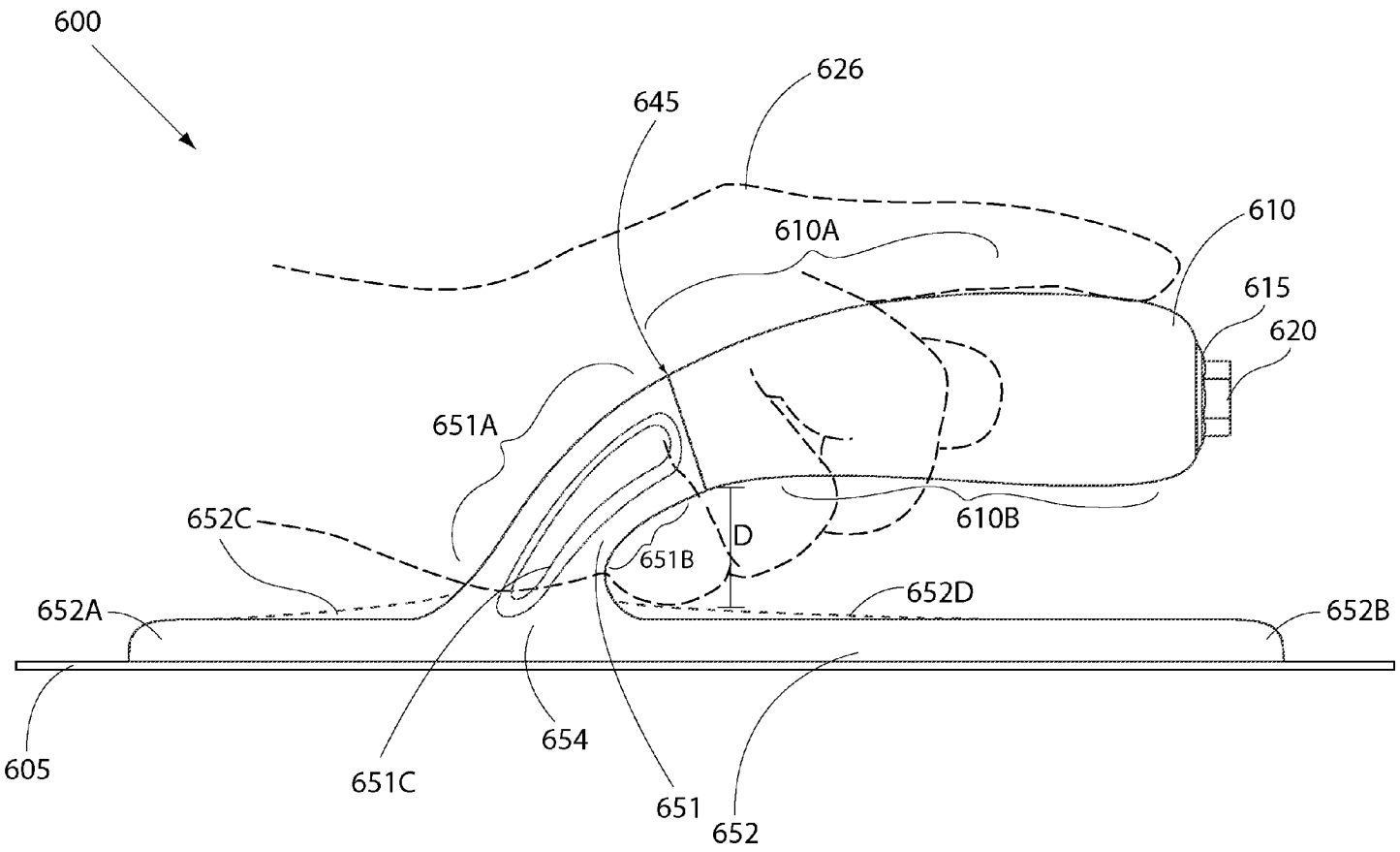

Referring now to FIG. 6B, an exemplary side view of a trowel 600 according to one embodiment of the present invention is provided and includes a hand 626 (shown in dashed lines) exemplary gripping in a lower reverse manner, but the grip has been modified so as to rotate the grip, move it slightly further toward the back of the trowel and handle, and extend the index finger across the top surface 610A of the handle 610 while moving the thumb (also shown in dashed lines) to the far side of the handle 610. Although the hand 626 fingers and thumb orientation is moved further toward the back of the handle 610, the primary pressure point of the hand 626 remains the palm area of the hand 626 and the butt of the palm of the hand 626 rests squarely on the handle connecting member 651, particularly on the front/top surface 651A of the handle connecting member 651. Again, in this manner and orientation of gripping, the handle connecting member 651 may be the primarily hand support mechanism while the handle with the fingers and thumb orientation thereon may become a control arm for proper orientation and movement of the trowel 600. Once again, in this embodiment the pinky finger may fit comfortably in the rounded rear facing surface of the connection area of the handle connecting member 651 and the blade attachment member 652 at connection area 654. The pinky finger may also abut the bottom/back surface 651B of the handle connecting member 651 and may abut the top of the blade attachment member 652, particularly if a slope 652D is provided.

Figure 7:
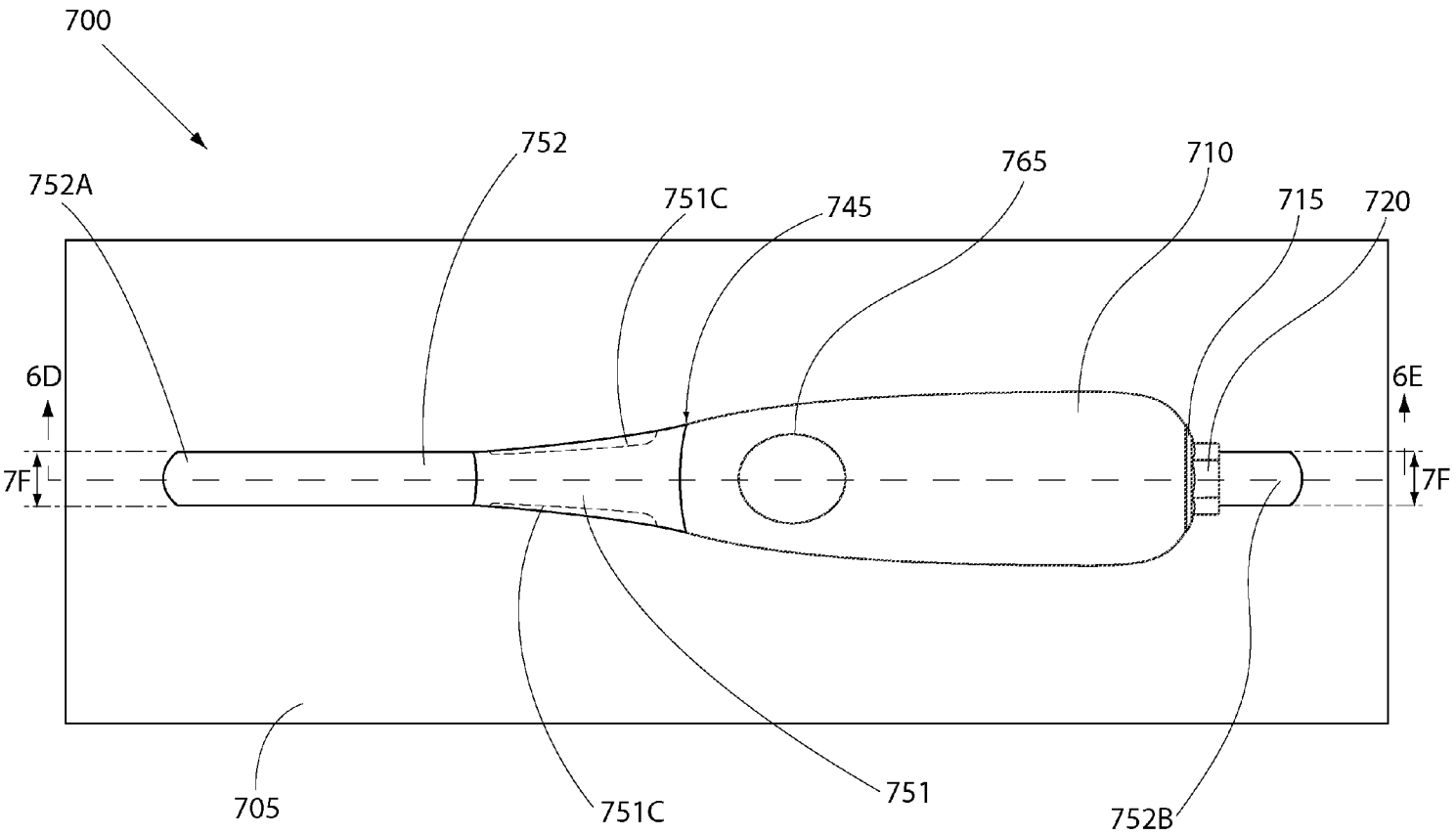
FIG. 7 is a top view of an exemplary trowel, according to at least one embodiment of the invention.

Referring to FIG. 7, a top view of an exemplary trowel 700, according to at least one embodiment of the present invention is shown. In this embodiment a thumb indent 765 has been added to the handle 710 and the I-beam cut away 751C has been indicated on the handle connection member 751, but is not the primary embodiment shown. The top view illustrates the rectangular shape of the blade 705 having straight sides. One skilled in the art recognizes that the blade may be one of many other shapes or designs, for example rounded, notched, irregular, etc., depending on the intended use of the trowel 700. The blade attachment member 752 of the tang is shown in this view as having ends 752A and 752B, and a width or thickness of 7F which may be in the range of, for example, 0.8-1.2 cm (¼ to ½ inches). Although the width may be wider, this exemplary range has proven sufficient for the stresses that this trowel will typically experience, even when the tang is made of lighter and less strong materials such as a metal including magnesium. The handle connection member 751 may be tapered from a narrow width equal to the width of 7F (e.g., 0.8-1.2 cm (¼ to ½ inches)) where it connects to the blade attachment member 752 up to a width of, for example, 2.5-3.5 cm (⅞ to 1⅜ inches) at the interface 745 of the handle connection member 751 and the handle 710. In preferred embodiments the width of the handle 710 and the abutting portion of the handle connection member 751 are made to be the same size so that there is a smooth transition in dimension between the two members. The width of the handle 710 at its widest portion may be, for example, 3.5 to 4.5 cm (1⅜ to 1⅞ inches), but may be made to any width as long as it fits comfortably in a user's hand. The far end of the handle 710 may be rounded. As will be seen more clearly in FIGS. 9 and 10A-10C, the handle may also preferably have a rounded or oval cross-section so that a user's hand may fit comfortably around it. As noted above, the handle may include a thumb indent or detent 765 where a thumb may comfortably set when the handle 710 is gripped in a typical forward manner. Further, the handle 710 may be attached to the tang using a plug, spacer or washer 715 and a nut or bolt 720. A cross-sectional line 6D-6E is provided so that a cross-section of handle 710 may be provides and the handle support member may be clearly seen and explained relative to FIG. 8 below.

Figure 8:
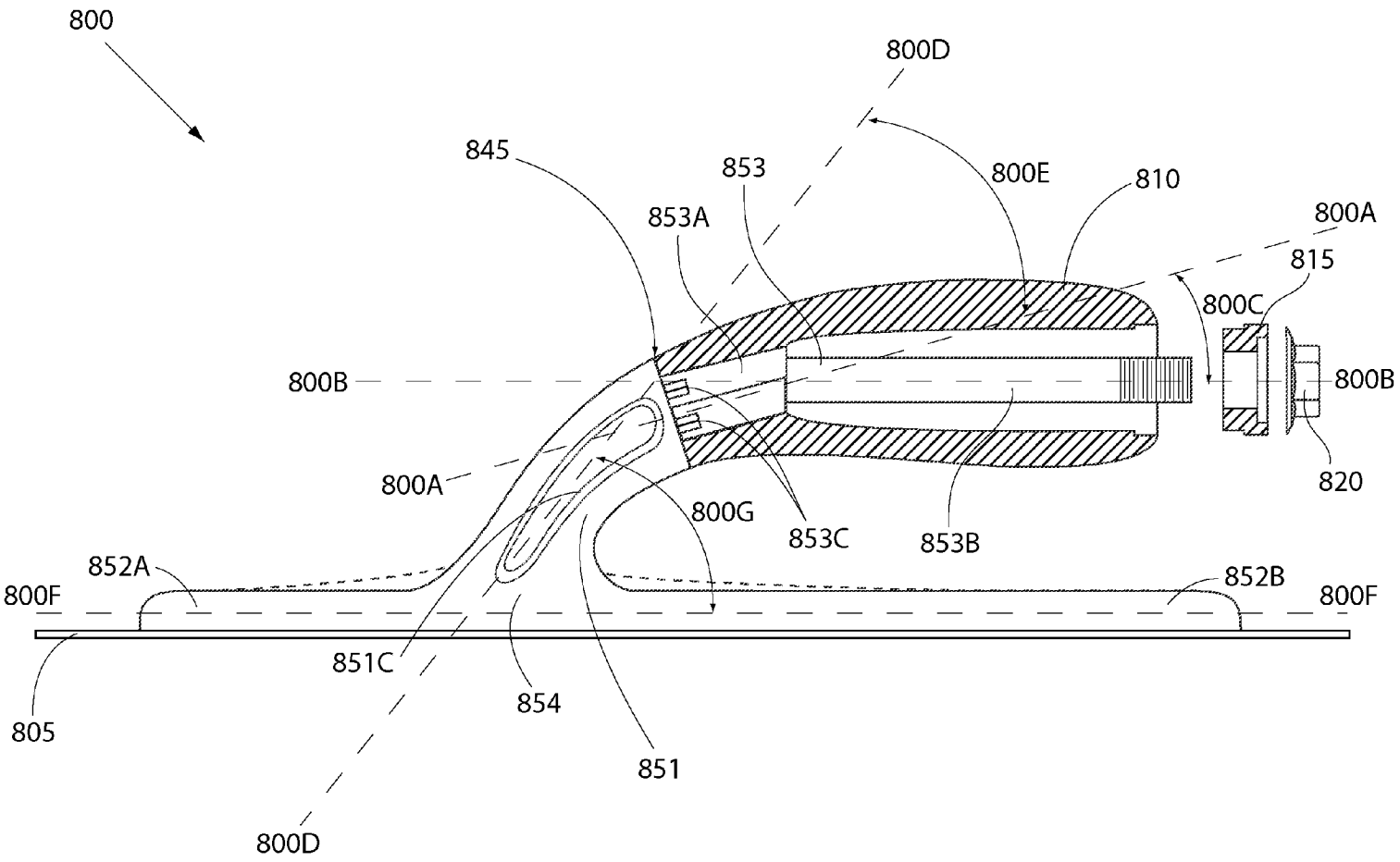
FIG. 8 is a cross-sectional view of an exemplary trowel of FIG. 7 taken across the line A, according to at least one embodiment of the invention.

Referring now to FIG. 8, a partial cross-sectional view (handle section 810) of an exemplary trowel of FIG. 7 taken across the line 7F-7F in FIG. 7 is shown, according to at least one embodiment of the invention. In this Figure it is shown that the tang may also include a unique handle support member 853. The handle support member may have three separate areas, handle orientation portion 853A, handle attachment stud 853B and handle rotation reduction mechanisms 835C that operate to ensure proper handle 810 mounting, connection, and orientation. As can be seen, the handle support member 853 and the hollow center interior of the handle 810 have two different angles incorporated therein. Various angles 800C, 800G, and 800E are shown for the various different slopes of the tang and handle support portions as illustrated with lines 800A-800A, 800B-800B, and 800D-800D. These angles and slopes are different than traditional trowel tangs and handle support configurations, and enable manufacturability of the curved or angled hand grip to the tang and comfortable gripping of the tool. As such, the handle support member 853 and hallowed out center interior of handle 810 have at least one angle that is not parallel with the plane of the blade 805 or the blade connecting member 852 axis. In this embodiment, the main axis 800A-800A of the handle orientation portion 835A is at an angle 800C, which may be, for example, approximately 10 to 20 degrees from the approximately horizontal axis 800B-800B of the handle axis stud 853B (which is approximately parallel with the lateral main axis 800F 0 800F of the blade attachment member 825). (Compare to FIG. 1D that shows a straight handle support member 153.) As noted previously, angle G (formed by axis 800D-800D and 800F-800F) may be approximately 45 degrees and may be formed at a larger or smaller angle as desired. The rotation reduction mechanisms 853C may be triangular shaped protrusions that are located approximately in the center of each side of a square shaped handle orientation portion 853A. The square shape of the handle orientation portion 853A may provide the primary proper orientation and rotation reduction for the handle 810, and the rotation reduction mechanisms 853C may provide secondary rotation reduction and may result in the hollow end (female) of the handle 810 appear in a pattern, for example an 8 pointed star shape, to match. Finally, the far hollow or hollowed out end of the handle 810 may be capped with a holed pug 815 through which a threaded end of the stud 853B may slide through. A nut 820 may then be threaded onto the threaded end of the stud 853B so that the plug and handle may be secured to the handle support member and pulled tight against the handle connecting member 851 at the interface 845, so as to be securely attached to the tang.

Figure 9:
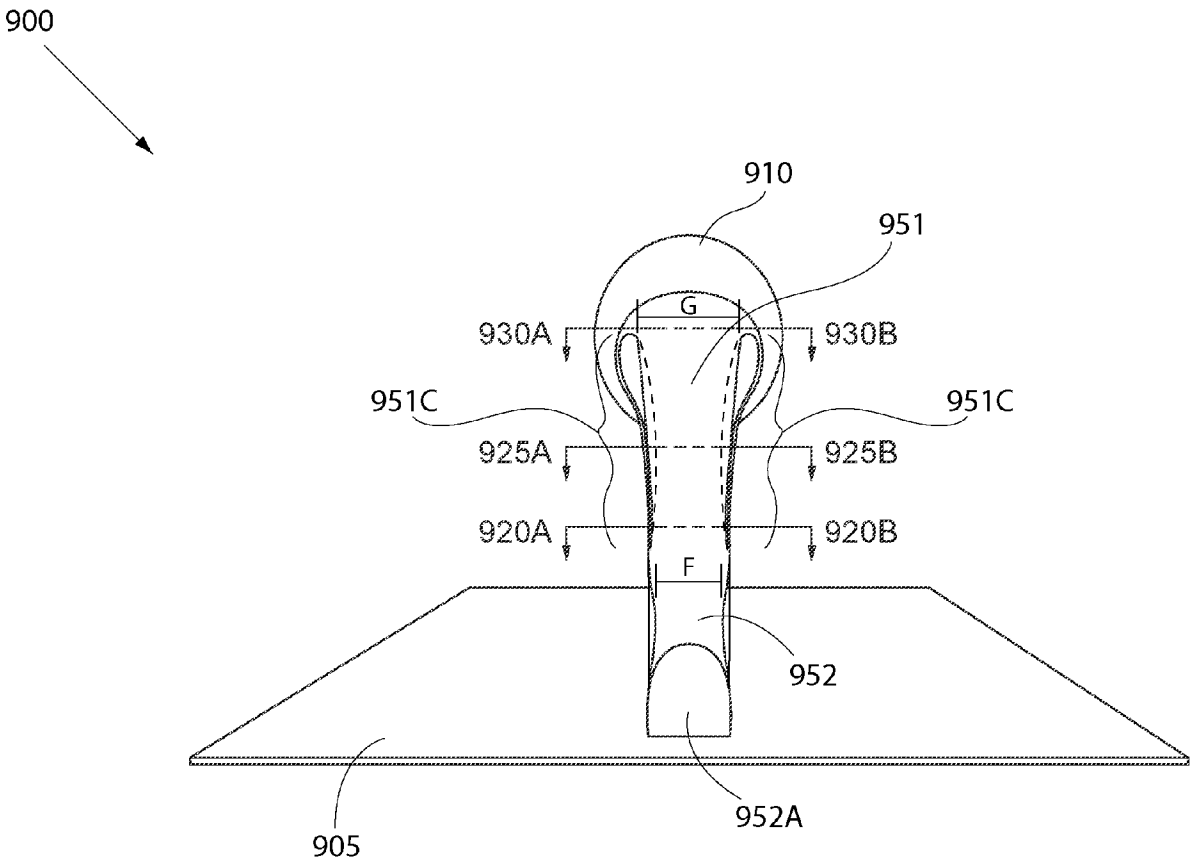
FIG. 9 is a front view of an exemplary trowel, according to at least one embodiment of the invention.

Referring now to FIG. 9, a front or forward perspective view of an exemplary trowel is shown, according to at least one embodiment of the invention. This view clearly shows the indented sides 951C on the left and right sides forming an I-beam shape on the handle connecting member 951. The handle 910 is shown to be at the top of the handle connecting member 951. The blade 905 is coupled to the bottom of the blade attachment member 952. The top of the blade attachment member 952 is attached to the bottom of the handle connecting member 951. Further, the handle connection member 951 may have a thicker top portion G and thinner bottom portion F, so as to smoothly transition from the interface with the handle 910 and the width of the blade attachment member 952 to improve the comfort of gripping the handle 910 and handle connecting member 951. Cross-section lines 920A-920B, 925A-925B, and 930A-930B, are provided to better indicate the removal of portions of the left and right side of the handle connecting member 951, as will be shown in FIGS. 10A-10C.

Figure 10A:
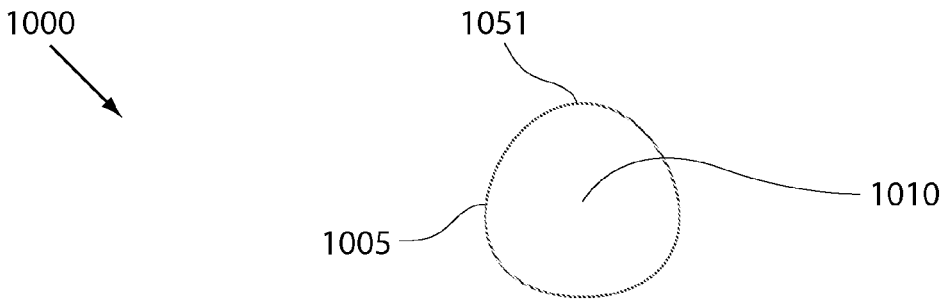
FIG. 10A-10C are cross-sectional views of an exemplary trowel of FIG. 9 taken across the lines 920A-920B, 925A-925B, and 930A-930B, respectively, according to at least one embodiment of the invention.
Figure 10B:
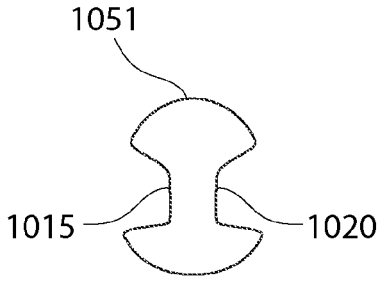
Figure 10C:
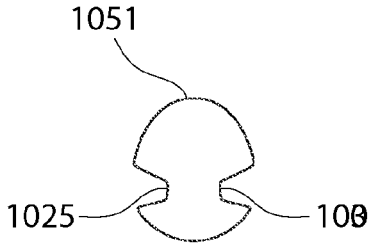

Referring to FIG. 10A-10C, cross-sectional views of an exemplary trowel of FIG. 9 with exemplary portions of the handle connecting member 910 removed to reduce weight, as taken across the lines 920A-920B, 925A-925B, and 930A-930B in FIG. 9, respectively, are shown, according to at least one embodiment of the invention. These figures show the varying cross sections of the connecting member 951. With respect to FIG. 10A, this is a cross-sectional view taken across line 930A-930B as provided by this exemplary embodiment. In this case the cross-section is taken high on handle connecting member 951 close to the handle 910 interface in and area that does not have material removed and is solid 1010. As shown, this area of the handle connecting member 951 is approximately an oval or egg shape 1005. With respect to FIG. 10B, this is a cross-sectional view taken across line 925A-925B as provided by this exemplary embodiment. In this case the cross-section is taken at approximately the middle section of the handle connecting member 951 and shows how material has been removed from the left side 1015 and right side 1020 of the handle connecting member 1051. As shown, in this exemplary embodiment the removal of material on the left side 1015 and right side 1020 results in an approximately I-beam shaped cross-section. With respect to FIG. 10C, this is a cross-sectional view taken across line 920A-920B as provided by this exemplary embodiment. In this case the cross-section is taken at the lower portion of the handle connecting member 951 and shows how material has been removed from the left side 1025 and right side 1030 of the handle connecting member 1051. As shown, in this exemplary embodiment the removal of material on the left side 1015 and right side 1020 results in an approximately I-beam shaped cross-section, albeit somewhat large on one side. As shown, the I-beam construction may have one portion thicker than another, e.g., the back/rear area may be thicker than the front portion. Although the reduced weight and removal of material in this exemplary embodiment results in an approximately I-beam shape, one skilled in the art would appreciate that material may be removed in a number of different ways and resulting shapes, and still provide sufficient weight reduction and strength for the material used to construct the tang and/or handle connection member 951.

Various processes may be used for forming the tang. One process includes injecting material into a mold having the desired geometry. If the material is metal such as Aluminum or magnesium a casting method may be used. If the material is a plastic, an injection molding process may be used. These processes may be used to create all or any part of the tang. In any case, once cast or injected, the mold may be opened and the part(s) may be removed. The part(s) may require minor finishing to complete, if there are some imperfections relative to the final desired shape(s). Another variation may be to insert mold a piece of stronger material imbedded inside a less strong lighter material.

Although a particular embodiment(s) of the present invention has been shown and described, it will be understood that it is not intended to limit the invention to the preferred embodiment(s) and it will be obvious to those skilled in the art that various changes and modifications may be made without departing from the spirit and scope of the present invention. Thus, the invention is intended to cover alternatives, modifications, and equivalents, which may be included within the spirit and scope of the invention as defined by the claims. Accordingly, the scope of the present invention should be determined not by the embodiments illustrated above, but by the claims appended hereto and their legal equivalents.

What is claimed is:

1. A hand tool for building construction, comprising:

a flat elongated blade;

a relatively round and curved handle having a round circular proximal end, a middle part, and a distal end, the round circular proximal end being thinner than the distal end and the middle part of the handle; and a tang connecting the handle to the blade, the tang including:

a blade attachment member connected in parallel with and to the flat elongated blade;

a handle connecting member, connecting the handle to the blade attachment member, having a major axis slope of between 20 degrees and 75 degrees from a major axis of the blade attachment member and the thickness from front to back of the handle connecting member varies lengthwise from thicker near an interface with the handle, to thinner in the middle, to thicker where the handle connecting member connects to the blade attachment means.

2. The hand tool for building construction of claim 1, wherein a front/top outer surface of the proximal end of the handle and the abutting front/top surface of the connecting member form a smooth and coincident arc curvature having approximately the same angle as the handle connecting member major axis slope has relative to the major axis of the blade attachment member.

3. The hand tool for building construction of claim 1, wherein an interface between the proximal end of the handle and an adjacent surface of the connecting member forms an angle more than 90 degrees relative to the major axis of the blade attachment member.

4. The hand tool for building construction of claim 1, wherein the handle connecting member major axis slope is between approximately 30 degrees and 60 degrees from the major axis of the blade attachment member.

5. The hand tool for building construction of claim 1, wherein the handle connecting member has a radial center line having an equal amount of material on either side of the radial center line and the handle connecting member is both a substantially curved member from top-to-bottom and a substantially round member from side-to-side.

6. The hand tool for building construction of claim 1, wherein the width of the handle connecting member varies lengthwise from thicker near an interface with the handle to thinner where the handle connecting member connects to the blade attachment means.

7. The hand tool for building construction of claim 1, wherein the proximal end to distal end of the handle is oriented in an elongated direction of the blade and the handle connecting member having a predetermined fixed major axis slope.

8. The hand tool for building construction of claim 1, wherein the handle connecting member has an I-beam shaped cross-section various locations along its radial axis so as to increase strength of the handle connecting member while reducing the weight of the trowel.

9. The hand tool for building construction of claim 1, wherein the tang is made of a material that includes magnesium that will not break or fracture when a user places excessive forces on the handle or handle connecting member.

10. The hand tool for building construction of claim 1, wherein the proximal end of the handle is thinner than the distal end of the handle and all locations along the handle in between the proximal end and the distal end of the handle.

11. A hand tool for building construction, comprising:

a handle having a proximal end and a distal end;

a trowel blade; and a tang including:

a blade attachment member connected in parallel with and to the trowel blade and approximately in parallel with the distal end of the handle, the blade attachment member being longer than the handle and extending beyond the distal end of the handle;

a handle connecting member connecting the handle to the blade attachment member, wherein the blade attachment member also has a gradually sloping tapered upper surface along its lateral length toward the handle connecting member on at least one side of the area where the blade attachment member and the handle connecting member meet, and wherein the blade attachment member gradually sloping upper surface is opposite a blade attachment surface of the blade and results in an increase thickness of the blade attachment member that varies along the length of the blade attachment member opposite the blade connection surface so as to improve the strength of the interface between the handle connecting member and blade attachment member.

12. The hand tool for building construction of claim 11, wherein the blade attachment member extends almost the entire length of the blade, both in front of and behind a connection point between the handle connecting member and the blade attachment member and the tang and handle are formed so that a user may comfortably grip the handle and handle connecting member in a forward direction so that one or more complete fingers of the user's hand is wrapped around the handle connecting member and not the handle.

13. The hand tool for building construction of claim 11, wherein the blade attachment member and a connection point between the handle connecting member and the blade attachment member have a width in the range of ¼ to ½ an inch, the gradually sloping upper surface along the blade attachment member lateral length spans the entire width of the blade attachment member, and the tang and handle are formed so that a user may comfortably grip the handle and handle connecting member in a reversed direction so that at least a portion of the user's palm rests comfortably on a front/top surface of the handle connecting member and one or more fingers of the user's hand is comfortably wrapped around the handle connecting member and not the handle.

14. The hand tool for building construction of claim 11, wherein the handle connecting member varies from a width in the range of ¼ to ½ an inch at the connection point between the handle connecting member and the blade attachment member, to a width in the range of ⅞ to 1⅜ inches at an interface of the handle connecting member and the proximal end of the handle.

15. The hand tool for building construction of claim 11, wherein the tang is a separate piece from the blade, and the blade and tang are made from different type of materials from one another.

16. A tool, comprising:

a handle;

a blade having a lateral axis along a major lateral plane; and a tang connecting the handle to the blade, including:

a handle connecting member, connecting the handle to a blade attachment member that is connected to the blade; and a multiple axis handle support member, surrounded by the handle and connected to the handle connecting member, and that slips into and through the approximate center of the handle as a male portion of a male-to-female coupling system connecting the handle to the blade attachment member, wherein the multiple axis handle support member has at least two axis coupled together, one axis that is approximately parallel with and one axis that is not approximately parallel with the major lateral plane and lateral axis of the blade.

17. The tool of claim 16, wherein the handle support member includes a handle orientation portion that has a square shape.

18. The tool of claim 17, wherein the handle support member further includes a plurality of triangular shaped rotation reduction mechanisms, one on each surface of the handle orientation portion square shape.

19. The tool of claim 16, wherein the handle support member includes a first elongated portion that is parallel with the major plane and axis of the blade and a second short portion that is not parallel with the major plane and axis of the blade.

20. The tool of claim 19, wherein the first elongated portion is cylindrical and the second short portion is a square shaped handle orientation portion that is not parallel with the major plane and axis of the blade.

* * * * *